United States Patent [19]

Yoshimoto et al.

[11] Patent Number: 4,994,360

[45] Date of Patent: Feb. 19, 1991

[54] SILVER HALIDE PHOTOGRAPHIC SENSITIVE MATERIAL

[75] Inventors: Shinji Yoshimoto; Satoshi Nakagawa; Yutaka Kaneko; Shuichi Sugita, all of Hino, Japan

[73] Assignee: Konica Corporation, Tokyo, Japan

[21] Appl. No.: 563,810

[22] Filed: Aug. 3, 1990

Related U.S. Application Data

[63] Continuation of Ser. No. 395,296, Aug. 17, 1989, abandoned, which is a continuation of Ser. No. 262,191, Oct. 19, 1988, abandoned, which is a continuation of Ser. No. 946,508, Dec. 24, 1986, abandoned.

[30] Foreign Application Priority Data

Dec. 28, 1985 [JP] Japan ..... 60-297512

[51] Int. Cl.[5] ..... G03C 7/38; G03C 7/392

[52] U.S. Cl. ..... 430/551; 430/558

[58] Field of Search ..... 430/551, 558

[56] References Cited

U.S. PATENT DOCUMENTS

| | | | |
|---|---|---|---|
| 4,060,418 | 11/1977 | Waxman et al. | 430/959 |
| 4,585,728 | 4/1986 | Furutachi et al. | 430/551 |
| 4,590,152 | 5/1986 | Sato et al. | 430/558 |
| 4,622,287 | 11/1986 | Umemoto et al. | 430/551 |
| 4,639,415 | 1/1987 | Kaneko et al. | 430/551 |

FOREIGN PATENT DOCUMENTS

| | | |
|---|---|---|
| 0081768 | 6/1983 | European Pat. Off. . |
| 0207794 | 7/1987 | European Pat. Off. . |

*Primary Examiner*—Charles L. Bowers, Jr.
*Assistant Examiner*—Mark R. Buscher
*Attorney, Agent, or Firm*—Jordan B. Bierman

[57] ABSTRACT

A silver halide photographic material comprising a pyrazolotriazole coupler represented by the following Formula I and a stabilizer represented by the following Formula VIII.

[I]

[XIII]

The substituents are as defined in the specification.

8 Claims, No Drawings

SILVER HALIDE PHOTOGRAPHIC SENSITIVE MATERIAL

This application is a continuation of application number 07/395,296 filed Aug. 17, 1989, now abandoned which is a continuation of application Ser. No. 262,191, filed Oct. 19, 1988, now abandoned which is a continuation of application Ser. No. 946,508, filed Dec. 24, 1986, now abandoned.

FIELD OF THE INVENTION

The present invention relates to a silver halide light-sensitive material, which features a dye image stable to light and heat, and, in which generation of a stain is prevented.

BACKGROUND OF THE INVENTION

It is conventionally well known in the art that, when a silver halide light-sensitive material containing a dye-forming coupler is exposed imagewise to light and processed with a color developing solution, an oxidant derived from a developing agent of an aromatic primary amine compound causes a coupling reaction with the dye-forming coupler to form a dye image made of such as an indophenol, indoaniline, indamine, azomethine, phenoxyazine, phenazine or dyes analogous to them.

What is required for the dye image obtained in such a manner is that it does not show discoloration or color fading even if it is stored under high temperature and/or high humidity. Additionally, what is required for the non-colored portion in a silver halide light-sensitive material (hereinafter referred to as color photographic material) is that it does not show yellow-stain (hereinafter referred to as Y-stain) due to light, heat or moisture.

However, in the case of a magenta coupler, the Y-stain in the non-colored portion due to light, heat or moisture as well as the color fading of the dye image portion due to light are extremely great, when compared to a yellow coupler or a cyan coupler, often causing troubles.

5-pyrazolones are widely used as couplers to form magenta dyes. It is a great disadvantage that dyes formed from 5-pyrazolo-5-ones have a secondary absorption in the range around 430 nm in addition to a primary absorption around 550 nm. Various attempts have been made in order to solve this disadvantage. A magenta coupler having anilino group in the third position of a 5-pyrazolone has a limited secondary absorption and is advantageous especially in obtaining a printed color image. Such a method is disclosed, for example, in U.S. Pat. No. 2,343,703 and UK Patent No.1,059,994.

However, the above-mentioned magenta couplers have a disadvantage that a shelf stability is limited, and especially, a light resistance of a dye image is significantly poor and in a disadvantageously great Y-stain in a non-colored portion.

In order to reduce the secondary absorption around 430 nm of the above-mentioned magenta couplers, the following magenta couplers have also been proposed. pyrazobenzimidazoles mentioned in U.K. Patent No. 1,047,612; indazolones mentioned in U.S. Pat. No. 3,770,447; 1H-pyrazolo [5,1-c]-1,2,4-triazole couplers disclosed in U.S. Pat. No. 3,725,067, U.K. Patents No. 1,252,418 and No. 1,334,515; 1H-pyrazolo [1,5,-b]-1,2,4-triazole couplers disclosed in Japanese Patent Publication Open to Public Inspection (hereinafter referred to as Japanese Patent O.P.I. Publication) No. 171956/1974 and Research Disclosure No. 24531; 1H-pyrazolo [1,5,-c]-1,2,3-triazole couplers disclosed in Research Disclosure No. 24626; 1-H-imidazo [1,2,-b] pyrazole couplers disclosed in Japanese Patent O.P.I. Publication No. 162548/1984 and Research Disclosure No. 24531; 1H-imidazo [1,5,-b]pyrazole couplers disclosed in Japanese Patent O.P.I. Publication No. 43659/1985 and Research Disclosure No. 24230; 1H-pyrazolo [1,5,-d] tetrazole couplers disclosed in Japanese Patent O.P.I. Publication No. 33552/1985 and Research Disclosure No. 24220. Among these examples, dyes formed from 1H-pyrazolo [5,1,-c]-1,2,4-triazole couplers, 1H-pyrazolo [1,5,-b]-1,2,4-triazole couplers, 1H-pyrazolo [1,5,-c]-1,2,3triazole couplers, 1H-imidazo [1,2,-b] pyrazole couplers, 1H-pyrazolo [1,5,-b] pyrazole couplers or 1H-pyrazolo [1,5,-d] tetrazole couplers have a significantly smaller secondary absorption around 430 nm of wavelength, when compared with the previously mentioned dyes formed from 5-pyrazolones having an anilino group in the 3-position. This feature is very advantageous in regard to the color reproduction. Additionally, it is an advantage of such dyes that they show the significantly decreased Y-stain in the non-colored portion due to light, heat or moisture. However, azomethine dyes formed from the couplers, above, are extremely vulnerable to light. And worse, the above-mentioned dyes are easily discolored by light, significantly jeopardizing the performance of color photographic materials, especially color photographic materials for print. Consequently, such dyes have not been employed for a practical use.

In order to improve the light-resistance of magenta dye images formed from 1H-pyrazolo [5,2,-c]-1,2,4-triazole magenta couplers, a method has been proposed in Japanese Patent O.P.I. Publication No. 125732/1974, where phenol compounds for phenyl ether compounds are added to 1H-pyrazolo [5,1,-c -1,2,4-triazole magenta couplers.

However, it was revealed that such an art is not fully effective in preventing the magenta dye image, mentioned above, from fading, and that the prevention of the discoloration due to light was near-impossible.

SUMMARY OF THE INVENTION

In view of the disadvantages above, the present invention has been developed. Therefore, it is the first object of the invention to provide a color photographic material which features an excellent color reproducibility as well as a significantly improved light-resistance of a magenta dye image.

It is the second object of the invention to provide a color photographic material which features a magenta dye image where the discoloration due to light is minimized.

It is the third object of the invention to provide a color photographic material in which the generation of a Y-stain in a non-colored portion due to light, heat or moisture is prevented.

The present invention specifically relates to a silver halide photographic light-sensitive material comprising at least one compound represented by the general formula [I] and at least one compound represented by the general formula [XII]:

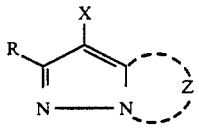

[I]

(wherein Z represents a group of non-metallic atoms necessary to complete a nitrogen-containing heterocyclic ring which may have a substituent; X represents a hydrogen atom or a substituent capable of being split off upon reaction with an oxidation product of a color developing agent; and R represents a hydrogen atom or a substituent):

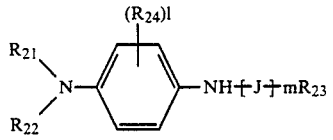

[XII]

(wherein $R_{21}$, $R_{22}$ and $R_{24}$ are independently selected from the group consisting of a hydrogen atom, an alkyl group, a cycloalkyl group, an alkenyl group, an aryl group and a heterocyclic group provided that the above-listed group may have a substituent; $R_{23}$ is selected frOm the group consisting of an alkyl group, a cycloalkyl group, an alkenyl group, and an aryl group of which respective groups have a substituent; $R_{24}$ is a group capable of being a substituent to the benzene ring of the formula; 1 is an integer of 0 to 4; J is selected from the group consisting of

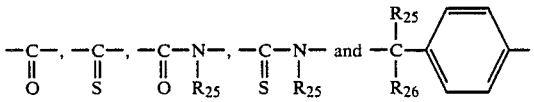

wherein, $R_{25}$ and $R_{26}$ are independently selected from a hydrogen atom and an alkyl group which may have a substituent; and m is 0 or 1 provided that $R_{21}$ and $R_{22}$ may be combined with each other to form a 5- or 6-membered ring, that when 1 is 2 or more $R_{24}$s' may be either the same or different and that $R_{24}$ may cooperatively be combined with $R_{21}$ or $R_{22}$ to form a 5- or 6-membered nitrogen-containing ring together with the nitrogen atom adjacent to $R_{21}$ or $R_{22}$.

The present inVention is specifically described, below.

In the general formula [I]the substituents expressed by R include, for example, a halogen atom, an alkyl group, a cycloalkyl group, an alkenyl group, a cycloalkenyl group, an alkinyl group, an aryl group, a heterocyclic group, an acyl group, a sulfonyl group, a sulfinyl group, a phosphonyl group, a carbamoyl group, a sulfamoyl group, a cyano group, a spiro compound residue, a bridged hydrocarbon compound residue, an alkoxy group, an aryloxy group, a heterocyclic oxy group, a siloxy group, an acyloxy group, a carbamoyloxy group, an amino group, an acylamino group, a sulfonamide group, an imide group, an ureide group, a sulfamoylamino group, an alkoxycarbonylamino group, an aryloxylcarbonylamino group, an alkoxycarbonyl group, an aryloxycarbonyl group, an alkylthio group, an arylthio group and a heterocyclicthio group As the halogen atom, a chlorine atom or a bromine atom is available, however, a chlorine atom is preferred.

As the alkyl group expressed by R, one having 1~32 carbon atoms is preferred. Also, as the alkenyl group or alkinyl group expressed by R, one having 1~32 carbon atoms is preferred. Additionally, as the cycloalkyl group or cycloalkenyl group, expressed likewise, one having 2~32 carbon atoms, and, more specifically, 5~7 carbon atoms is preferred, and, the alkyl group, alkenyl group and alkinyl group may be whichever straight-chained or branched.

At the same time, the alkyl group, alkenyl group, alkinyl group, cycloalkyl group and cycloalkenyl group, mentioned above, may possess the following substituents: an aryl group, cyano group, halogen atom, heterocycle, cycloalkyl, cycloalkenyl, spiro compound residue, bridged hydrocarbon compound residue, and;

substituents so combined via a carbonyl group, such as an acyl group, carboxy group, carbamoyl group, alkoxycarbonyl group or aryloxycarbonyl group. Additionally, as the substituents so combined via a hetero atom, the following are available:

ones so combined via an oxygen atom, such as a hydroxy group, alkoxy group, aryloxy group, heterocyclicoxy group, siloxy group, acyloxy group, carbamoyloxy group, and;

ones so combined via a nitrogen atom, such as a nitro group, amino groups including dialkylamino and others, a sulfamoylamino group, alkoxycarbonylamino group, aryloxycarbonylamino group, acylamino group, sulfonamide group, imide group or ureide group, and;

ones so combined via a sulfur atom, such as an alkylthio group, arylthio group, heterocyclicthio group, sulfonyl group, sulfinyl group, sulfamoyl group, and;

ones so combined via a phosphor atom, such as a phosphonyl group and others.

More specifically, there are the examples such as the following:

a methyl group, ethyl group, isopropyl group, t-butyl group, pentadecyl group, heptadecyl group, 1-hexylnonyl group, 1,1'-dipentylnonyl group, 2-chlor-t-butyl group, trifluoromethyl group, 1-ethoxytridecyl group, 1-methoxyisopropyl group, methanesulfonylethyl group, 2,4-di-t-amylphenoxymethyl group, anilino group, 1-phenylisopropyl group, 3-m-butanesulfonaminophenoxypropyl group, 3-4'-{α-[4''(p-hydroxybenzenesulfonyl) phenoxy] dodecanoylamino} phenylpropyl group, 3-{4'-[α-(2'',4''-di-t-amylphenoxy) butaneamide] phenyl}-propyl group, 4-[α-(o-chlorphenoxy) tetradecanaminophenoxy] propyl group, allyl group, cyclopentyl group and cyclohexyl group.

As the aryl group expressed by R, a phenyl group is preferable and may have a substituent, such as an alkyl group, alkoxy group, acylamino group and others.

More specifically, as the aryl group, a phenyl group, 4-t-butylphenol group, 2,4-di-t-amylphenyl group, 4-tetradecanamidophenyl group, hexadecyroxyphenyl group, 4'-[α-(4''-t-butylphenoxy) tetradecanamide] phenyl group and others should be noted.

As the heterocyclic group expressed by R, a 5~7-membered group is preferable, and, it may have a substituent or it may have been condensed. More specifically, a 2-furyl group, 2-thienyl group, 2-pyrimidinyl group, 2-benzothiazolyl group and others should be noted.

As the acyl group expressed by R, the examples including the following are available:

an alkylcarbonyl group such as an acetyl group, phenylacetyl group, dodecanoil group, α-2,4-di-t-amylphenoxybutanoil group and others, and; an arylcarbonyl group such as a benzoyl group, 3-pentadecyloxybenzoyl group, p-chlorobenzoyl and others.

As the sulfonyl group expressed by R, the examples including the following are available:

an alkylsulfonyl group such as a methylsulfonyl group and dodecylsulfonyl group; an arylsulfonyl group such as a benzenesulfonyl group and p-toluenesulfonyl group.

As the sulfinyl group expressed by R, the examples including the following are available:

an alkylsulfinyl group such as an ethylsulfinyl group, octylsulfinyl group and 3-phenoxybutylsulfinyl group; an arylsulfinyl group such as a phenylsulfinyl group and m-pentadecylphenylsulfinyl group.

As the phosphonyl group expressed by R, the examples including the following are available:

an alkylphosphonyl group such as a butylctylphosphonyl group; an alkoxyphosphonyl group such as an octyloxyphosphonyl group; an aryloxyphosphonyl group such as a phenoxyphosphonyl group; an arylphosphonyl group such as a phenylphosphonyl group.

The carbamoyl group expressed by R may possess a substituent such as an alkyl group, aryl group (preferably, a phenyl group) and others. As the carbamoyl group, the examples including the following are available: an N-methylcarbamoyl group, N,N-dibutylcarbaboyl group, N-(2-pentadecyloctylethyl) carbamoyl group, N-ethyl-N-dodecylcarbamoyl group, N-[3-(2,4-di-t-amylphenoxy) propyl] carbamoyl group.

The sulfamoyl group expressed by R may possess a substituent such as an alkyl group, aryl group (preferably, a phenyl group). As the sulfamoyl group, the examples including the following are available: an N-propylsulfamoyl group, N,N-diethylsulfamoyl group, N-(2-pentadecyloxyethyl) sulfamoyl group, N-ethyl-N-dodecylsulfamoyl group and N-phenylsulfamoyl group.

As the examples for the spiro compound residue expressed by R, a spiro [3,3] heptane-1-yl and others are available.

As the bridged hydrocarbon compound residue expressed by R, the examples including the following are available: a bicyclo [2.2.1] heptane-1-yl, tricyclo [3.3.1.1 3'7] decane1-yl, 7,7-dimethyl-bicyclo [2.2.1] heptane-1-yl and others.

The alkoxy group expressed by R may further possess one of the substituents exemplified for the alkyl group, mentioned before. For such an example the following are available: a methoxy group, propoxy group, 2-ethoxyethoxy group, pentadecyloxy group, 2-dodecyloxyethoxy group, phenethyloxyethoxy group and others.

As the aryloxy group expressed by R, a phenyloxy is preferred. The aryl nucleus may further possess one of the substituents or atoms exemplified for the aryl group, mentioned before. As the examples the following are included: a phenoxy group, p-t-butylphenoxy group and m-pentadecylphenoxy and others.

As the heterocyclicoxy group expressed by R, one having 5~7 membered heterocycle is preferred, and additionally, the heterocycle may have a substituent. The examples include a 3,4,5,6-tetrahydropyranyl group 1-phenyltetrazole-5-oxy group.

The siloxy group expressed by R may further possess a substituent such as an alkyl group or another group. The examples include a trimethylcyloxy group, triethylcyloxy group, dimethylcyloxy group and others.

As the acyloxy group expressed by R, the examples such as an alkylcarbonyloxy group and an arylcarbonyloxy group are available. Further, such an acyloxy group may possess a substituent. More specifically, an acetyloxy group, ?-chloroacetyloxy, benzoyloxy and others should be noted as the examples for such an acyloxy group.

The carbamoyloxy group expressed by R may have a substituent such as an alkyl group or aryl group. For such a carbamoyloxyl group, an N,N-diethylcarbamoyloxy group, N-phenylcarbamoyloxy group and others are available.

The amino group expressed by R may have a substituent such as an alkyl group or aryl group (preferably, a phenyl group). For such an amino group, an ethylamino group, anilino group, m-chloranilino group, 3-pentadecyloxycarbonylanilino group, 2-chloro-5-hexadecanamidanilino and other groups are available.

As an acylamino group expressed by R, an alkylcarbonylamino group, arylcarbonylamino group (preferably, a phenylcarbonylamino group) and others are available. Further, such an acylamino group may possess a substituent, and, more specifically, the examples such as an acetamide group, α-ethylpropanamide group, N-phenylacetamide group, dodecanamide group, 2,4-di-t-amylphenoxyacetamide group, α-3-t-butyl-4-hydroxyphenoxybutanamide group and others are available.

As a sulfonamide group expressed by R, an alkylsulfonylamino group, arylsulfonylamino group and others are available. Further, such sulfonamide groups may possess a substituent, and, more specifically, the examples including a methylsulfonylamino group, pentadecylsulfonylamino group, benzenesulfonamide group, p-toluenesulfonamide group, p-toluenesulfonamide group, 2-methoxy-5-t-amylbenzenesulfonamide group and others are available.

An imide group expressed by R may be whichever an open-chained group or a cyclic group, and, may possess a substituent. For such an imide group, the examples including an imide succinate group, 3-heptadecylimide succinate group, phthalimide group, glutarimide group and others are available.

An ureide group expressed by R may have such a substituent as an alkyl group or aryl group (preferably, a phenyl group). The examples of such an ureide group include an N-ethylureide group, N-methyl-N-decylureide group, N-phenylureide group, N-p-tolylureide and other groups.

An sulfamoylamino group expressed by R may have such a substituent as an alkyl group or aryl group (preferably, a phenyl group). The examples of such a sulfamoylamino group include an N,N-dibutylsulfamoylamino group, N-methylsulfamoylamino group, N-phenylsulfamoylamino group and others.

An alkoxycarbonylamino group expressed by R may possess a substituent. As the examples of such a group, a methoxycarbonylamino group, methoxyethoxycarbonylamino group, octadecyloxycarbonylamino group and others are available.

An aryloxycarbonylamino group expressed by R may possess a substituent. As the examples of such a group, a phenoxycarbonylamino group, 4-methylphenoxycarbonylamino group and others are available.

An alkoxycarbonyl group expressed by R may possess a substituent. As the examples of such a group, a methoxycarbonyl group, butyloxycarbonyl group, dodecyloxycarbonyl group, octadecyloxycarbonyl group, ethoxymethoxycarbonyl group, benzyloxycarbonyl group and others are available.

As the examples of such a group, a methoxycarbonyl group, butyloxycarbonyl group, dodecyloxycarbonyl group, octadecyloxycarbonyl group, ethoxymethoxycarbonyl group, benzyloxycarbonyl group and others are available.

An aryloxycarbonyl group expressed by R may possess a substituent. As the examples of such a group, a phenoxycarbonyl group, p-chlorophenoxycarbonyl group, m-pentadecyloxycarbonyl group and others are available.

An alkylthio group expressed by R may possess a substituent. As the examples of such a group, an ethylthio group, dodecylthio group, octadecylthio group, phenethylthio group and 3-phenoxypropyltho group are available.

As an arylthio group expressed by R, a phenylthio group is preferred. Additionally, the arylthio group may possess a substituent. For such a group, the following examples are available: a phenylthio group, p-methoxyphenylthio group, 2-t-octylphenylthio group, 3-octadecylphenylthio group, 2-carboxyphenylthio group, p-acetaminophenylthio group and others.

As a heterocyclic thio group, a 5~7 membered group is preferred. At the same time, such a group may possess a condensed ring and/or a substituent. For such a group, the following examples are available: a 2-pyridylthio group, 2-benzothiazorylthio group and 2,4-diphenoxy-1,3,5-1,3,5-triazole-6-thio group.

As a substituent, expressed by X, which may split off due to a reaction with an oxidant derived from a color developing agent, the similar substituents which are so coupled through one of halogen atoms (a chlorine atom, bromine atom, fluorine atom and others) or a carbon atom, oxygen atom, sulfur atom or nitrogen atom contained thereof are available.

Other than a carboxyl group, for the substituents so combined through a carbon atom, a group expressed by the following general formula as well as a hydroxymethyl group and a triphenylmethyl group are available. ($R_1'$ has the same meaning as R, mentioned previously, Z' has the same meaning as Z, mentioned previously. $R_2'$ and $R_3'$ respectively represent any one of a hydrogen atom, aryl group, alkyl group and heterocyclic group.)

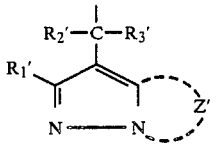

The substituents so combined through an oxygen atom thereof include an alkoxy group, aryloxy group, heterocyclic oxy group, acyloxy group, sulfonyloxy group, alkoxycarbonyloxy group, aryloxycarbonyloxy group, alkyloxalyloxy group and alkoxyoxalyloxy group.

The alkoxy groups may further possess a substituent, and, the examples for such a substituent include an ethoxy, 2-phenoxyethoxy group, 2-cyanoethoxy group, phenethyloxy group, p-chlorobenzyloxy group and others.

As the aryloxy group, phenoxy groups are preferable, and, the aryl group may further possess a substituent More specifically, the examples for the substituent include a phenoxy group, 3-methylphenoxy group, dodecylphenoxy group, 4-methanesulfonamidephenoxy group, 4-[α-(3'-pentadecylphenoxy) butanamide] phenoxy group, hexadecylcarbamoylmethoxy group, 4-cyanophenoxy group, 4-methanesulfonylphenoxy group, 1-naphthyloxy group, p-methoxyphenoxy group and others.

As the heterocyclic oxy group, a 5~7-membered heterocyclic oxy group is preferred, and, the group may be of a condensed ring or may have a substituent. More specifically, the heterocyclic oxy groups include a 1-phenyltetrazolyloxy group, 2-benzothiazolyloxy group and others.

As the acyloxy groups, the following examples are available: alkylcarbonyloxy groups including an acetoxy group and butanoylxoxy group; alkenylcarbonyloxy groups including a cynnamoyloxy group; arylcarbonyloxy groups including a benzoyloxy group.

As the sulfonyloxy groups, a butanesulfonyloxy group and methanesulfonyloxy groups, for example, are available.

As the alkoxycarbonyloxy groups, an ethoxycarbonyloxy group and benzyloxycarbonyloxy group, for example, are available.

As the aryloxycarbonyl groups, a phenoxycarbonyloxy group and others are available.

As the alkyloxalyloxy groups, a methyloxalyloxy group, for example, is available.

As the alkoxyoxalyloxy groups, an ethoxyoxalyloxy group and others are available.

The substituents so coupled through a sulfur atom thereof include, for example, an alkylthio group, arylthio group, heterocyclic thio group, alkyloxythiocarbonylthio group.

The alkylthio groups include a buthylthio group, 2-cyanoethylthio group, phenethylthio group, benzylthio group and others.

The arylthoi groups include a phenylthio group, 4-methanesulfonamidophenylthio group, 4-dedecylphenethylthio group, 4-nonafluoropentanamidophenethyl group, 4-carboxyphenylthio group, 2-ethoxy-5-t-buthylphenylthio group and others.

The heterocyclic thio groups include, for example, 1-phenyl-1,2,3,4-tetrazolyl-5-thio group, 2-benzothiazolyl group and others.

The alkyloxythiocarbonylthio groups include a dodecyloxythiocarbonylthio group and others.

The substituents, mentioned above, which are so coupled through a nitrogen atom include, for example, ones expressed by a general formula

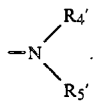

In this case, $R_4'$ and $R_5'$ respectively represent any one of a hydrogen atom, alkyl group, aryl group, heterocyclic group, sulfamoyl group, carbamoyl group, acyl group, sulfonyl group, aryloxycarbonyl group and alkoxycarbonyl group. $R_4'$ and $R_5'$ may combine with each other to form a heterocycle. However, $R_4'$ and $R_5'$ are not simultaneously hydrogen atoms.

The alkyl group may be whichever straight-chained or branched, and, preferably, should have 1~22 carbon atoms. Additionally, such an alkyl group may contain a substituent. As the substituent the following are available:

an aryl group, alkoxy group, aryloxy group, alkylthio group, arylthio group, alkylamino group, arylamino group, acylamino group, sulfonamide group, imino group, acyl group, alkylsuffonyl group, arylsulfonyl group, carbamoyl group, sulfamoyl group, alkoxycarbonyl group, aryloxycarbonyl group, alkyloxycarbonylamino group, aryloxycarbonylamino group, hydroxyl group, carboxyl group, cyano group and halogen atom. As the specific examples for the alky group, an ethyl group, octyl group, 2-ethylhexyl group and 2-chlorethyl group are available.

The aryl group expressed by $R_4'$ or $R_5'$, one having 6~32 carbon atoms, in particular, a phenyl group or naphthyl group is preferred. The aryl group may have a substituent. For such a substituent, those substituents expressed by $R_4'$ or $R_5'$, and described, above, as contained in the alkyl group as well as the alkyl group itself are available. More specifically, the aryl groups include, for example, a phenyl group, 1-naphthyl group and 4-methylsulfonylphenyl group.

As the heterocycle group expressed by $R_4'$ or $R_5'$, a 5~6-membered group is preferred, and, the group may be of a condensed ring or may have a substituent. More specifically, the heterocycle groups include a 2-furyl group, 2-pyrimidyl group, 2-benzothiazolyl group, 2-pyridyl group and others.

As the sulfamoyl group expressed by $R_4'$ or $R_5'$, an N-alkylsulfamoyl group, N,N-dialkylsulfamoy group, N-arylsulfamoyl group, N,N-diarylsulfamoyl group and others are available. The alkyl group or aryl group contained in the sulfamoyl group may have the substituent contained within the alkyl group or aryl group mentioned before. As the specific examples for the sulfamoyl group, an N,N-diethylsulfamoyl group, N-methylsulfamoyl group, N-dodecylsulfamoyl group and N-p-tolylsulfamoyl group, for example, are available.

As the carbamoyl group expressed by $R_4'$ or $R_5'$, an N-alkylcarbamoyl group, N,N-dialkylcarbamoyl group, N-arylcarbamoyl group, N,N-diarylcarbamoyl group and others are available. The alkyl group or aryl group contained in the carbamoyl group may have the substituent contained within the alkyl group or aryl group mentioned previously. As the specific examples for the carbamoyl group, N,N-diethylcarbamoyl group, N-methylcarbamoyl group, N-dodecylcarbamoyl group, N-p-cyanophenylcarbamoyl group and N-p-tricarbamoyl group are available.

As the acyl group expressed by $R_4'$ or $R_5'$, an alkyloarbonyl group, arylcarbonyl group and heterocyclic carbonyl group, for example, are available. The alkyl group, aryl group and heterocyclic group may possess a substituent. As the specific examples of the acyl group, a hexafluorobutanoyl group, 2,3,4,5,6-pentafluorobenzoyl group, acetyl group, benzoyl group, naphthoyl group, 2-furylcarbonyl group and others are available.

As the sulfonyl group expressed by $R_4'$ or $R_5'$, an alkylsulfonyl group, arylsulfonyl group, heterocyclic sulfonyl group are available. Such sulfonyl groups may have a substituent, and, more specifically, include an ethanesulfonyl group, benzenesulfonyl group, octanesulfonyl group, naphthalenesulfonyl group, p-chlorobenzenesulfonyl group and others.

The aryloxycarbonyl group expressed by $R_4'$ or $R_5'$ may contain a substituent contained in the previously mentioned aryl group. More specifically, for such an aryloxycarbonyl group, a phenoxycarbonyl group and others are available.

The alkoxycarbonyl group expressed by $R_4'$ or $R_5'$ may contain a substituent contained in the previously mentioned alkyl group. More specifically, for such an alkoxycarbonyl group, a methoxycarbonyl group, dodecyloxycarbonyl group, benzyloxycarbonyl group and others are available.

The heterocycle formed by mutual bonding of $R_4'$ and $R_5'$, a 5~6-membered one is preferred, and, may be saturated or unsaturated, and, may be whichever aromatic or unaromatic, and may be of a condensed ring. The examples of the heterocycle, mentioned above, include an N-phthalimide group, N-succinimide group, 4-N-urazolyl group, 1-N-hydantoinyl group, 3-N-2,4-dioxooxazolidinyl group, 2-N-1,1-dioxo-3(2H)-oxo-1,2-benzothiazolyl group, 1-pyrrolyl group, 1-pyrrolidinyl group, 1-pyrazolinyl group, 1-pyrazolisinyl group, 1-piperidinyl group, 1-pyrrolinyl group, 1-imidazolyl group, 1-imidazolynyl group, 1-indolyl group, 1-isoindolynyl group, 2-isoindolyl group, 2-isoindolynyl group, 1-benzotriazolyl group, 1-benzoimidazolyl group, 1-(1,2,4-triazolyl) group, 1-(1,2,3-triazolyl) group, 1-(1,2,3,4-tetrazolyl) group, N-morpholinyl group, 1,2,3,4-tetrahydroquinolyl group, 2-oxo-1-pyrrolidinyl group, 2-1H-pyridone group, phthaladinone group 2-oxo-1-pyperidinyl group and others. These heterocyclic groups may have any one of the substituents such as an alkyl group, aryl group, alkyloxy group, aryloxy group, acyl group, sulfonyl group, alkylamino group, arylamino group, acylamino group, sulfonamino group, carbamoyl group, sulfamoyl group, alkylthio group, arylthio group, ureide group, alkoxycarbonyl group, arylkoxycarbonyl group, imide group, nitro group, cyano group, carboxyl group, halogen atom and others.

As the heterocycle containing nitrogen atoms and formed from Z or Z', a pyrazole ring, imidazole ring, triazole ring, tetrazole ring and others are available. As the substituent each of the heterocycle may have any one of the substituents described for R, mentioned previously.

Additionally, if the substituent (for example R, $R_1$~$R_8$) in the heterocycle expressed by general formula [I]or one of general formulas [II]~[VII], which are described later, has the portion, below, the so-called bis-type coupler is formed;

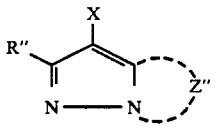

(R'', X and Z'' are, respectively, the same as R, X and Z in general formula [I].) Naturally, such a type of a coupler is included within the scope of the invention. Additionally, the ring formed from Z, Z', Z'' or $Z_1$, which is mentioned later, may further contain another condensed ring (for example, a 5~7-membered cycloalkene ring). For example $R_5$ and $R_6$ in general formula [V], or, $R_7$ and $R_8$ in general formula [VI] may mutually combine to form a ring (for example, a 5~7-membered cycloalkene or benzene ring).

The groups which are expressed by general formula [I] are more specifically expressed by the general formulas, such as, [II]~[VII], below.

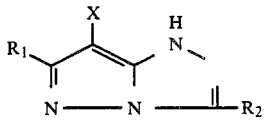

General formula [II]

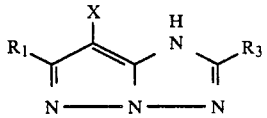

General formula [III]

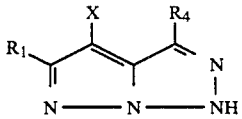

General formula [IV]

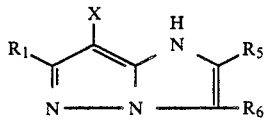

General formula [V]

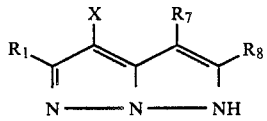

General formula [VI]

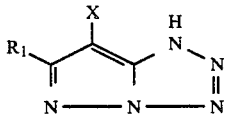

General formula [VII]

In the above-mentioned general formulas [II]~[VII], $R_1$ ~$R_8$ and X respectively have the same meanings as RS and X, mentioned previously.

Additionally, among those expressed by general formula [I], the preferable ones are expressed by general formula [VIII], below.

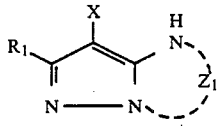

General formula [VIII]

$R_1$, X and $Z_1$ are the same as the R, X and Z in the general formula [I].

Among the magenta couplers expressed by the above-mentioned general formulas [II]~[VII], the similar coupler expressed by general formula [II]is especially preferred.

Additionally, in regard to a substituent contained within a heterocycle in general formulas [I]~[VIII], R in general formula [I]is preferred. In general formulas [II]~[VIII], $R_1$ is preferred if it satisfies the following criterion 1, and is more preferred if it satisfies the criteria 1 and 2, and, is much more preferred if it simultaneously satisfies the criteria 1, 2 and 3.

Criterion 1 A root atom directly with the heterocycle is a carbon atom.

Criterion 2 Only one hydrogen atom, if any, is with the carbon atom mentioned above.

Criterion 3 The coupling between the carbon atom mentioned above and adjacent atoms are exclusively of single coupling.

As a substituent R or $R_1$ within the above-mentioned heterocycle, the similar substituent expressed by the general formula [XI], below, is most highly favored.

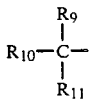

General formula [IX]

In the formula, $R_9$, $R_{10}$ and $R_{11}$ respectively represent any of the following:

a hydrogen atom, halogen atom, alkyl group, cycloalkyl group, alkenyl group, cycloalkenyl group, alkinyl group, aryl group, heterocyclic group, acyl group, sulfonyl group, sulfinyl group, phosphonyl group, carbamoyl group, sulfamoyl group, cyano group, residue of spiro compound, residue of bridged hydrocarbon compound, alcoxy group, aryloxy group, heterocyclic oxy group, siloxy group, acyloxy group, carbamoyloxy group, amino group, acylamino group, sulfonamide group, imide group, ureide group, sulfamoylamino group, alkoxycarbonylamino group, aryloxycarbonylamino group, alkoxycarbonyl group, aryloxycarbonyl group, alkylthio group, arylthio group, heterocyclic thio group. However, only one of $R_9$, $R_{10}$ and $R_{11}$ is, at maximum, a hydrogen atom.

Additionally, two of $R_9$, $R_{10}$ and $R_{11}$, mentioned above $R_9$ and $R_{10}$, for example may mutually combine to form a ring, whichever saturated or unsaturated (for example, a cycloalkane, cycloalkene and heterocycle), wherein $R_{11}$ may combine with the ring, above, to form a residue of a bridged-hydrocarbon compound.

Any of the groups expressed by $R_9$~$R_{11}$ may have a substituent. As the examples of groups expressed by $R_9$~$R_{11}$ as well as the examples of substituent which the above-mentioned groups may contain, the groups, expressed by R in general formula [I], mentioned before, and the substituents thereof are available.

Additionally, as the rings formed by bonding of $R_9$ and $R_{10}$, for example, and, as the examples of residues of bridged hydrocarbon compounds formed from two of $R_9$~$R_{10}$, and, as the substituents which such residues may contain, the examples of a cycloalkyl, cycloalkenyl, and heterocyclic bridged-hydrocarbon compound residue expressed by R in general formula [I], mentioned previously, and, the substituents which the examples may contain, are available.

The following cases are preferable among those expressed by general formula [IX].

(i) Two of $R_9$~$R_{11}$ are alkyl groups.

(ii) One of $R_9$~$R_{11}$, $R_{11}$, for example, is a hydrogen atom, and, other two, that is, $R_9$ and $R_{10}$ mutually combine to form a cycloalkyl group in combination with a root? hydrogen atom.

More specifically, in (i), the example, where two of $R_9$~$R_{11}$ are alkyl groups, and, the remaining one is a hydrogen atom or an alkyl group, is preferable.

In this case, the alkyl groups and the cycloalkyl group may further possess a substituent. As the examples for the alkyl groups, cycloalkyl group and the substituent, the examples for the alkyl groups and cycloalkyl groups expressed by R in the previously mentioned general formula [I] and for the substituents possessed by the groups are available expressed.

Additionally, as the examples for the substituents whose ring is formed from Z in general formula [I] or $Z_1$ in general formula [VIII], and, as $R_2 \sim R_8$ in general formulas [II]~[VI], those expressed by the general formula [X], below, are preferable.

General formula [X]

$$-R_1-SO_2-R_2$$

In the formula, above, $R_1$ represents an alkylene, $R_2$, denotes an alkyl, cycloalkyl or aryl.

The alkylene expressed by $R_1$ should have more than two, and, more preferably, three to six carbon atoms in the straight chain portion. The alkylene may be whichever straight-chained or branched, and, further, may possess a substituent.

As the examples for the above-mentioned substituent, the substituents which was so described that the alkyl group represented by R in the previously mentioned general formula [I] may possess, are available.

As the preferable substituent, a phenyl should be noted.

The following are the preferable examples for the alkylene expressed by $R_1$.

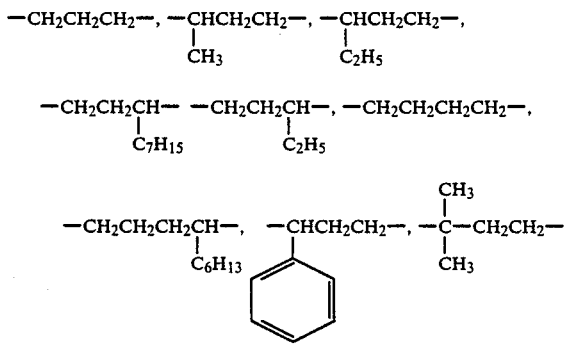

The alkyl group expressed by $R_2$ may be whichever straight-chained or branched.

More specifically, the examples for such an alkyl group include a methyl, ethyl, propyl, isopropyl, butyl, 2-ethylhexyl, octyl, dodecyl, tetradecyl, hexadecyl, octadecyl, 2-hexyldecyl and others are available.

As the cycloalkyl group expressed by $R_2$, 5~6-membered groups are preferable, and, a cyclohexyl, for example, is available.

The alkyl or cycloalkyl expressed by $R_2$ may have a substituent.

As the examples for such a substituent, those described for the substituents which the previously-mentioned $R_1$ may have are available.

As the aryl expressed by R,, the examples include a phenyl and naphthyl. The aryl group may have a substituent. As examples of such a substituent, a straight-chained or branched alkyl group as well as those described as substituents the previously mentioned $R_1$ may possess.

If the aryl group have more that two substituents, these substituents may be whichever identical or different.

The compounds expressed by general formula [I]and most highly favored are those expressed by general formula [XI], below.

General formula [XI]

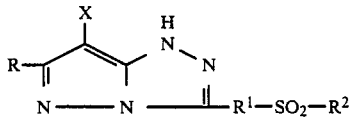

In the formula, R and X are identical to R and X in general formula [I], and, $R_1$ and $R_2$ are identical to $R_1$ and $R_2$ in general formula [X].

The following illustrate the examples of the compounds employed in the present invention.

M-1

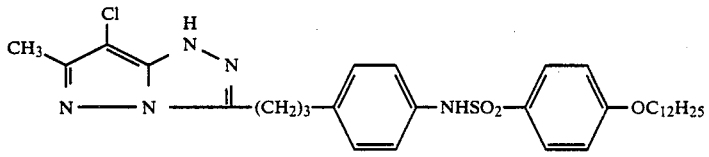

M-2

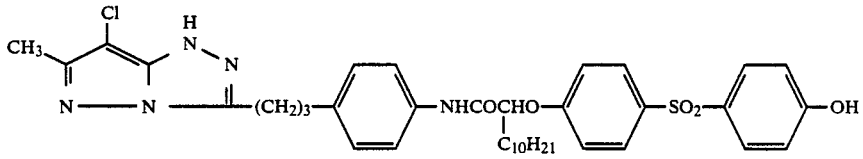

M-3

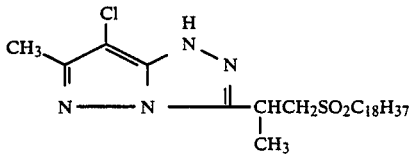

-continued
M-4
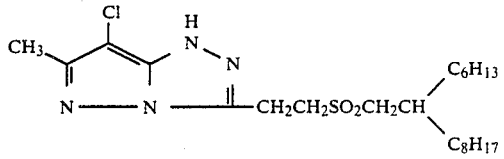
M-5
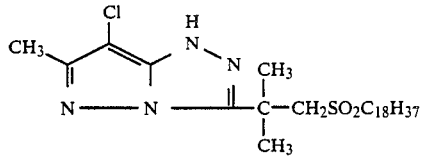
M-6
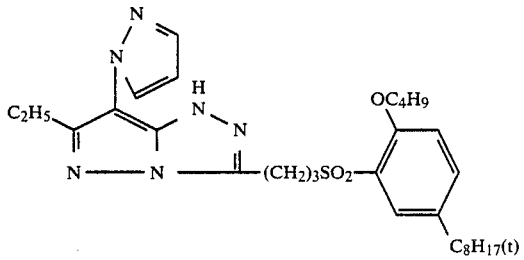
M-7
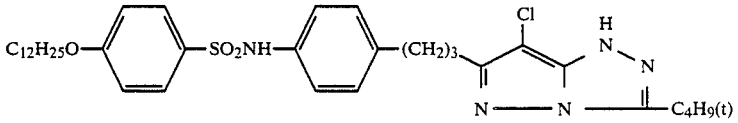
M-8
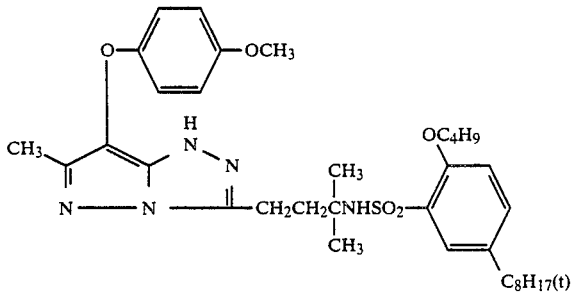
M-9
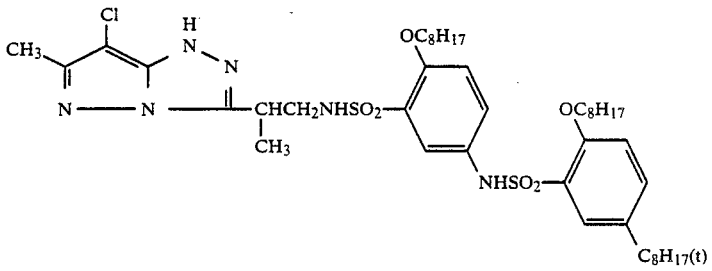
M-10
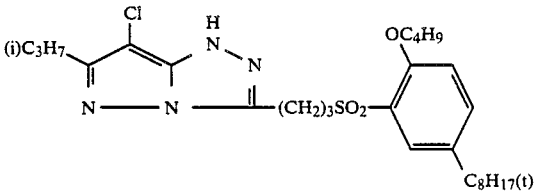

-continued
M-11
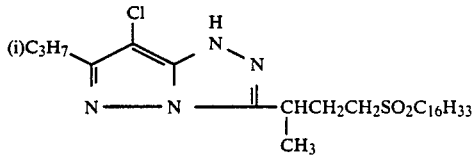
M-12
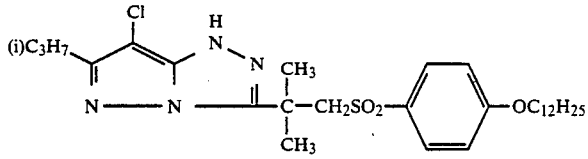
M-13
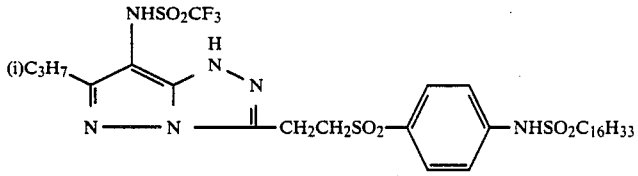
M-14
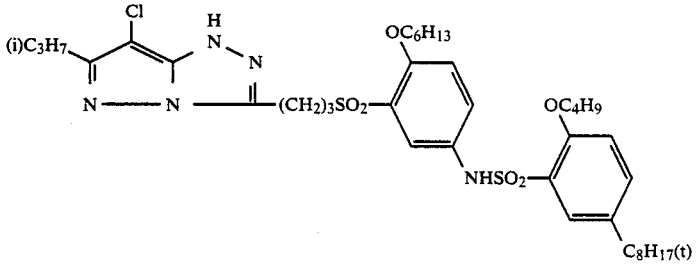
M-15
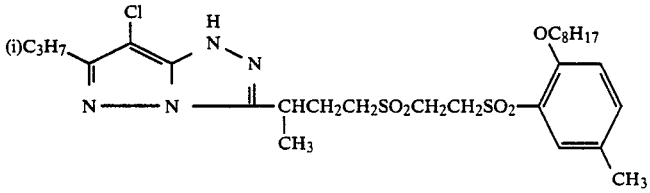
M-16
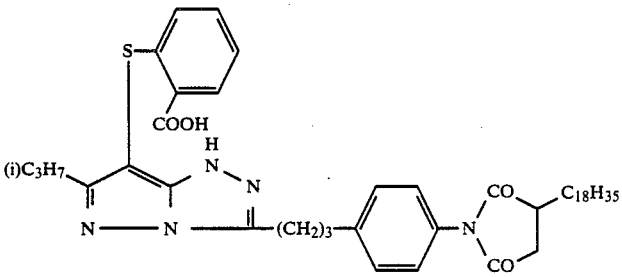
M-17
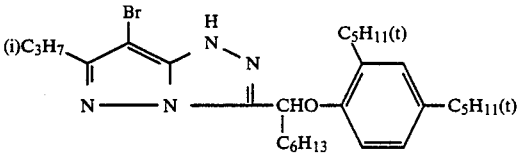
M-18
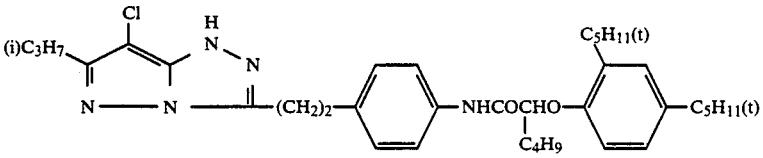

-continued
M-19
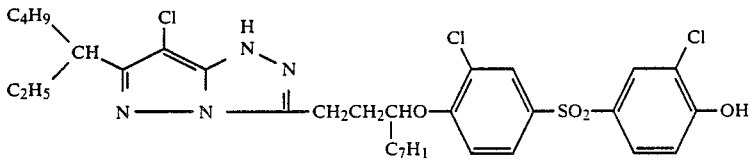
M-20
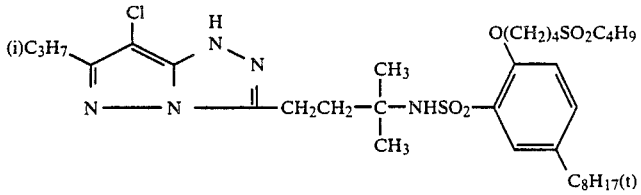
M-21
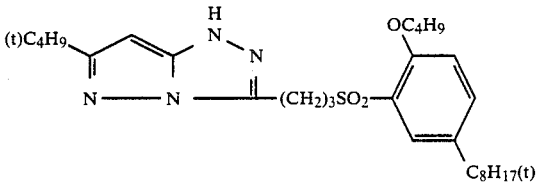
M-22
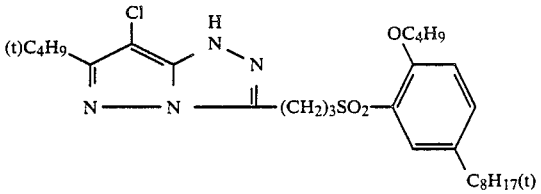
M-23
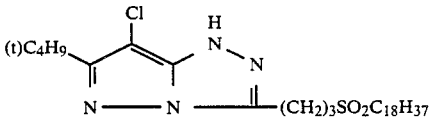
M-24
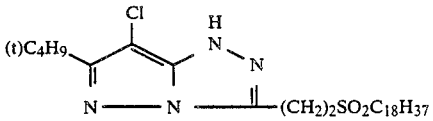
M-25
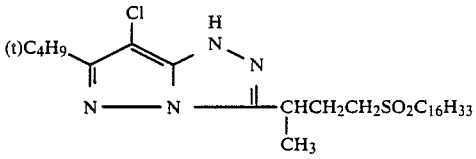
M-26
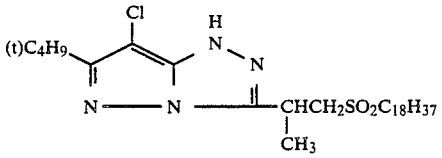
M-27
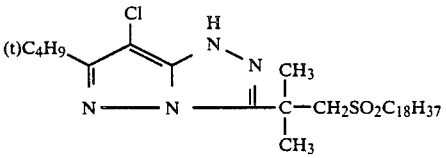

-continued
M-28
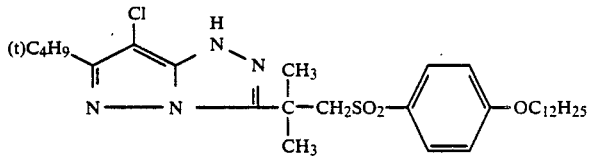
M-29
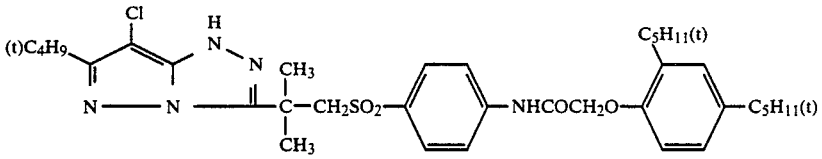
M-30
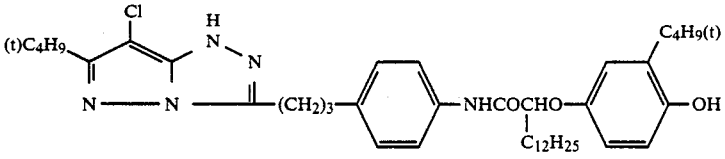
M-31
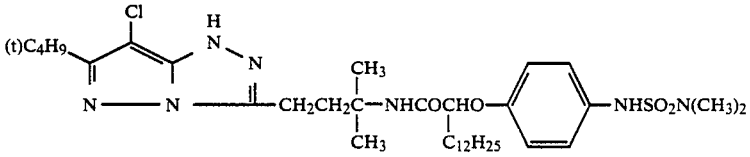
M-32
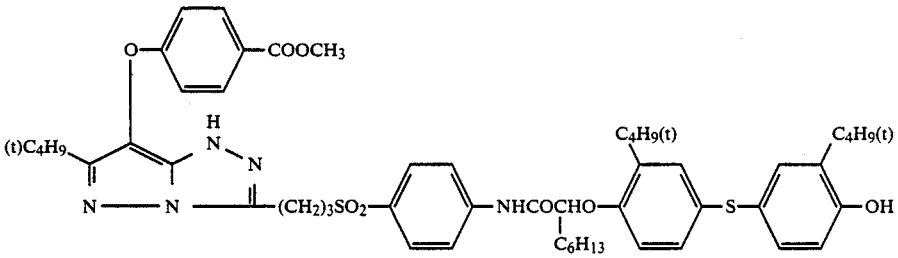
M-33
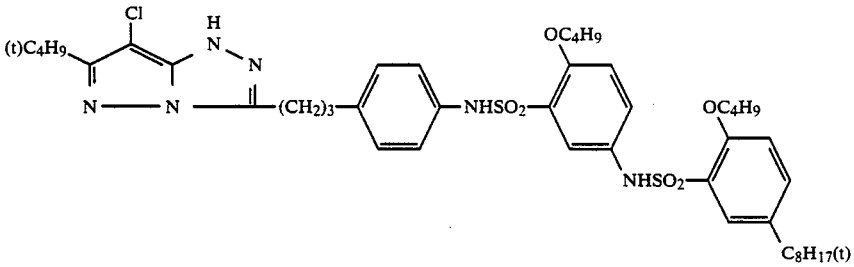
M-34
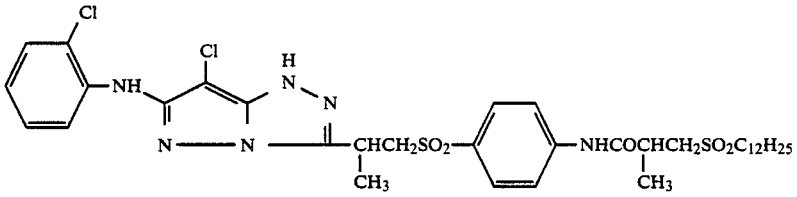
M-35
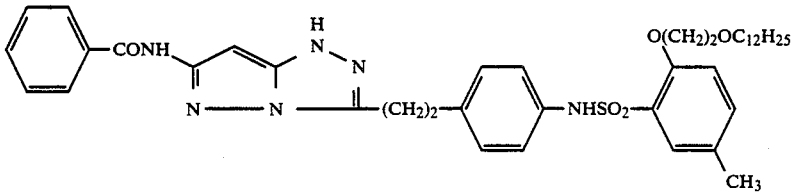

-continued
M-36
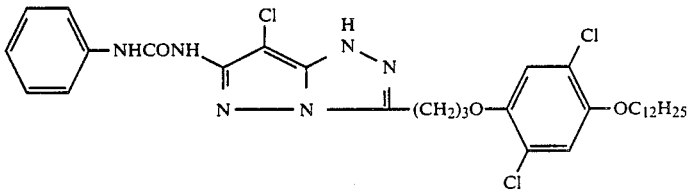
M-37
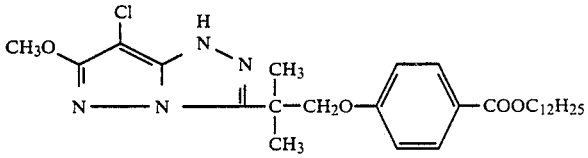
M-38
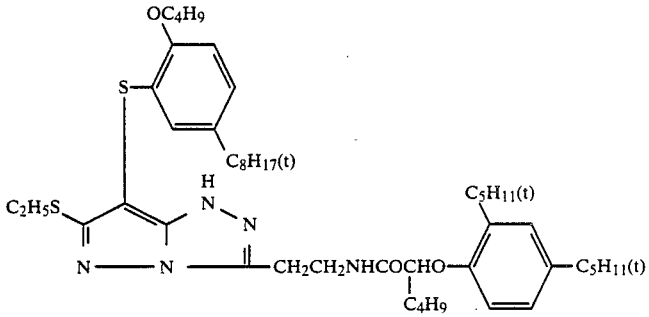
M-39
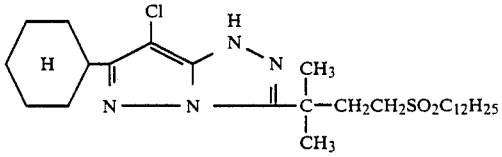
M-40
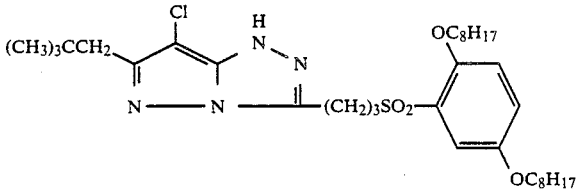
M-41
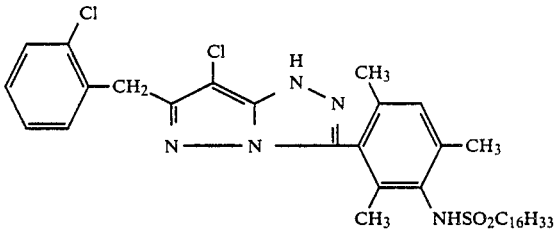
M-42
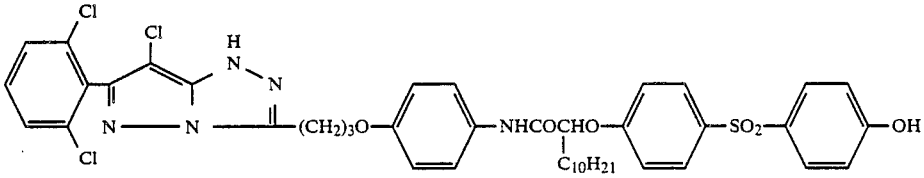

-continued
M-43
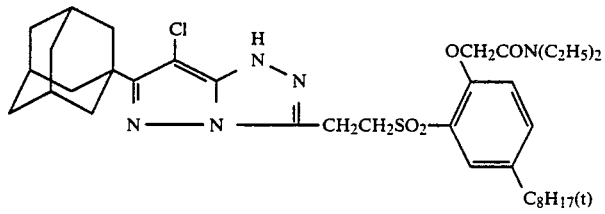
M-44
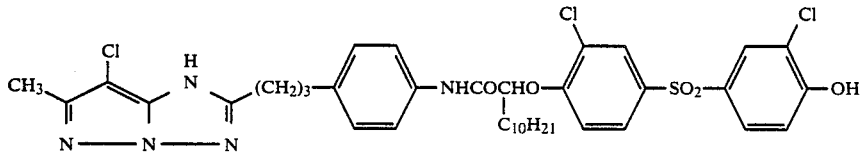
M-45
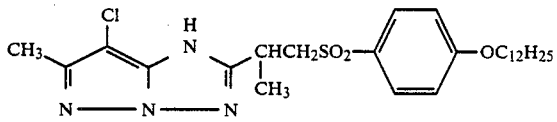
M-46
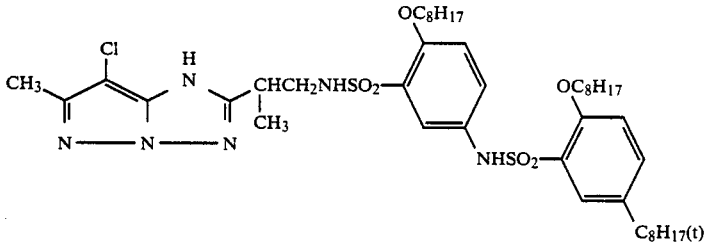
M-47
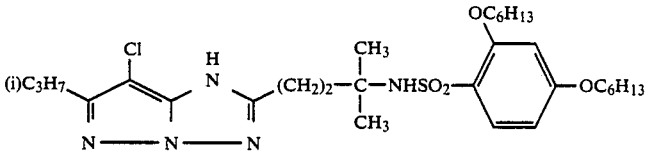
M-48
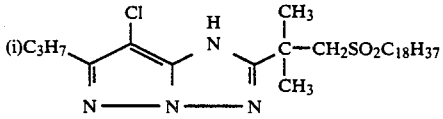
M-49
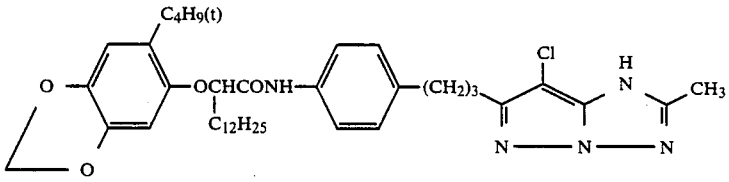
M-50
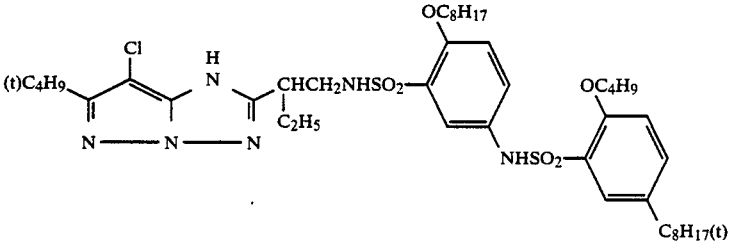

-continued
M-51
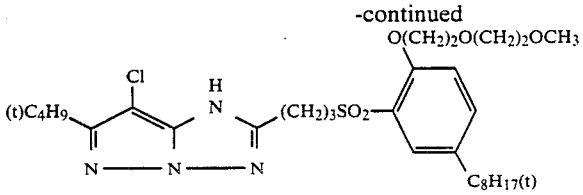
M-52
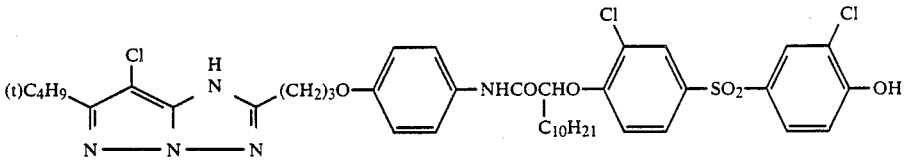
M-53
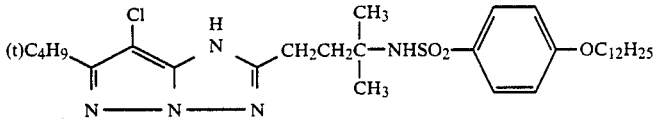
M-54
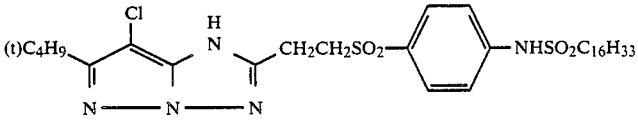
M-55
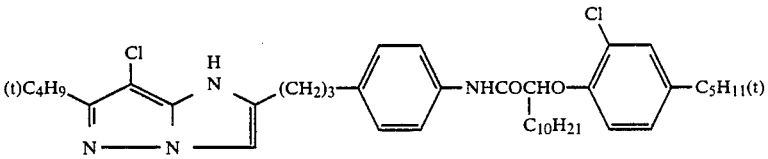
M-56
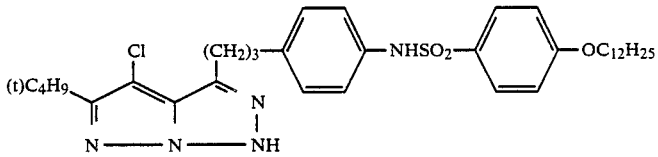
M-57
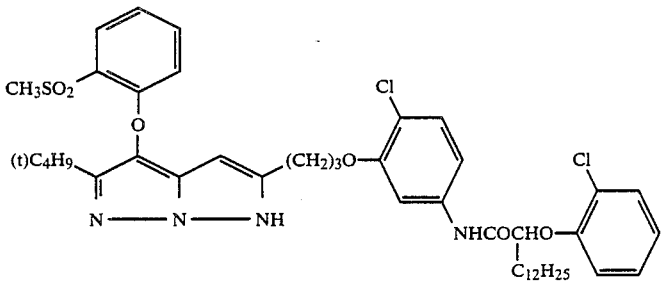
M-58
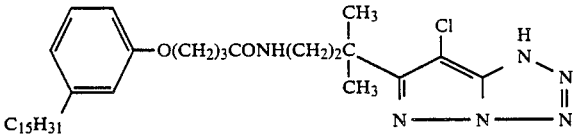
M-59
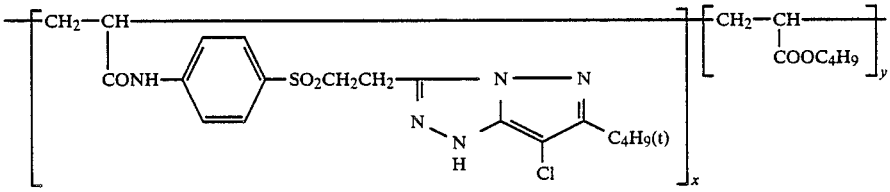
x:y = 50:50

-continued

M-60

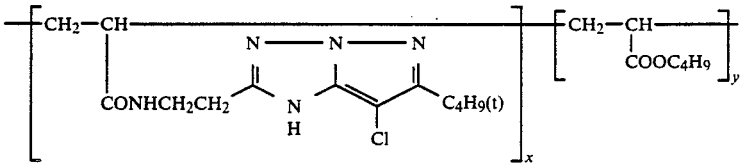

x:y = 50:50

M-61

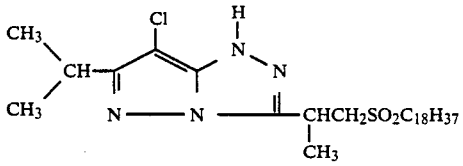

M-62

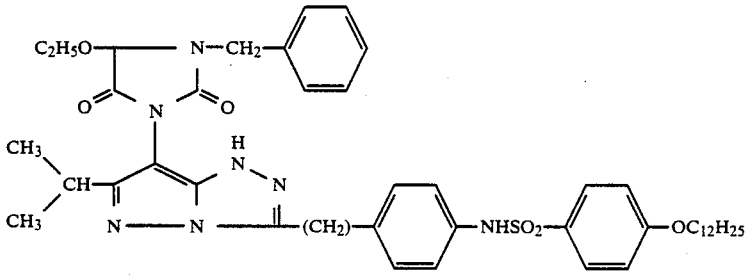

These couplers employed in the present invention can be synthesized by referring to the descriptions in, for instance, Journal of the Chemical Society, Perkin I (1977), 2047~2052, U.S. Pat. No. 3725067, Japanese Patent O.P.I. Publications No. 99437/1984, No. 42045/1983, No. 162548/1984, No. 171956/1984, No. 33552/1985, No. 43659/1985, No. 172982/1985 and No. 190779/1985.

The couplers employed in the present invention may be principally employed at the rate of $1\times10^{-3}\sim1$, or, preferably, $1\times10^{-2}\sim8\times10^{-1}$ mol per mol of silver halide.

Additionally, the couplers according to the present invention may be employed in combination with other types of magenta couplers, as far as such an employment does not jeopardize the objects of the present invention.

The dye-image stabilizer represented by the general formula [XII], which is used in combination with the magenta dyeforming coupler of the formula [I] in the present invention will be further described next.

In the formula, as the examples of alkyl group, cycloalkyl group, alkenyl group, aryl group and heterocyclic group, of which respective groups may have a substituent, for $R_{21}$ and $R_{22}$, those groups as listed in the examples of R of the formula [I] can be mentioned.

This also applies to the alkyl group for $R_{25}$ and $R_{26}$ in the formula when J is either one of

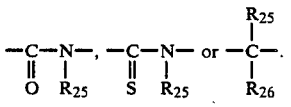

$R_{24}$ may be any atom or group which can be a substituent to the benzene, including, for example, a halogen atom, an alkyl group, an alkenyl group, an aryl group, an aralkyl group, an alkoxy group, an alkenoxy group, an aryloxy group, an alkylthio group, an arylthio group, an acyl group, an acyloxy group, an acylamino group, a diacylamino group, an alkylamino group, a sulfonamide group and an alkoxycarbonyl group.

As for the substituent for $R_{23}$, for example, hydroxy group, an alkoxy group, an aryl group, an acylamino group, a sulfonamide group, an aryloxy group, a carbamoyl group, a sulfamoyl group, a sulfonyl group, a vinyl sufonyl group, nitro group, cyano group, a halogen atom, carboxyl group, amino group, an alkylamino group, an alkoxycabonyl group, an acyl group, an aryaminocarbonyloxy group, an acyloxy group and a heterocyclic group can be mentioned.

Further the aryl group may form, for example, by being cooperatively combined with neibouring two groups, a methylene dioxy ring.

Among dye image stabilizers expressed by the general formula [XII], those in which $R_{21}$ and $R_{22}$ are combined with each other to form a 5- or 6-membered ring are preferable in the present invention.

As for preferable examples of the 5- or 6-membered rings, a pyrrolidine, a piperidine, a piperadine and a morpholine can be mentioned.

As for J of the formula,

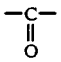

can be mentioned as a preperable example.

Thus among the dye image stabilizers those which are preferably used in the present invention can be given by the following formula [XIII]:

[XIII]

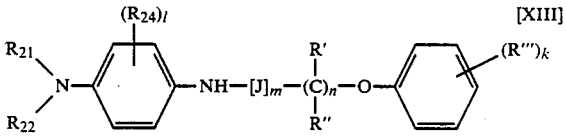

(Wherein, $R_{21}$, $R_{22}$, $R_{24}$ J, l and m respectively represent the same as defined in the formula [XII], R' and R'' independently represent a hydrogen atom or an alkyl group R''' is the same as $R_{24}$, n is an integer of 1 to 3 and k is an integer of 0 to 5.)

The dye image stabilizers which are most advantageously used in the present invention are those represented by the formula [XIV]:

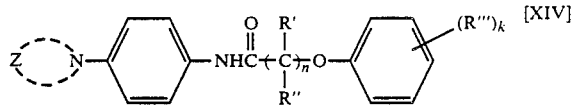

[XIV]

(Wherein, Z represents a group of atoms necessary to form a 5- or 6-membered ring, R', R'', R''', n and k are respectively the same as defined in formula [XIII]).

Representative examples of the compound represented by the formula [XII] are hereinbelow given, however, the scope of the present invention is not limited by these examples:

HI-1

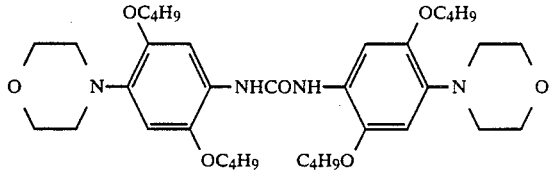

HI-2

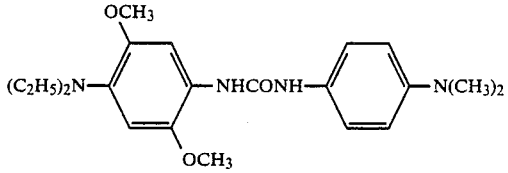

HI-3

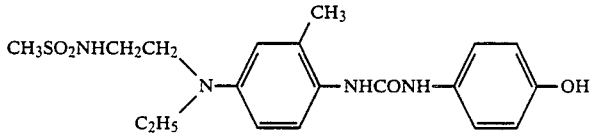

HI-4

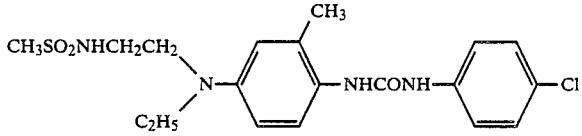

HI-5

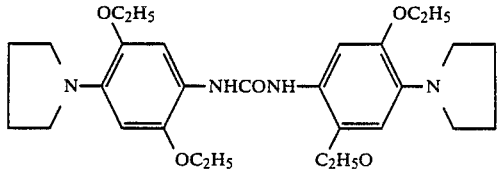

HI-6

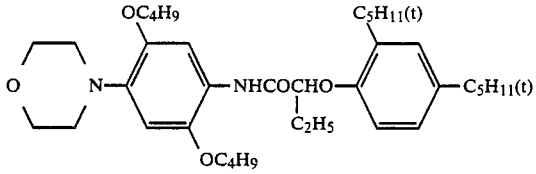

HI-7

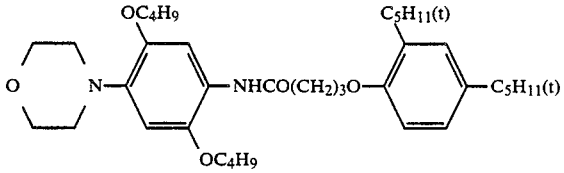

-continued
HI-8
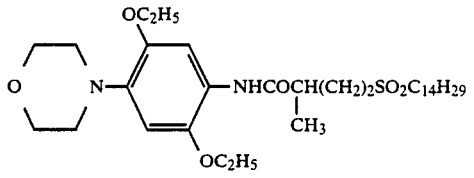
HI-9
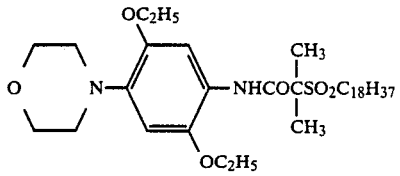
HI-10
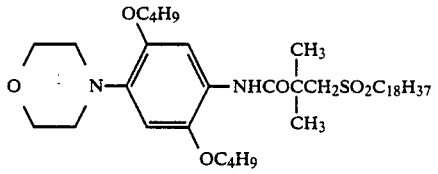
HI-11
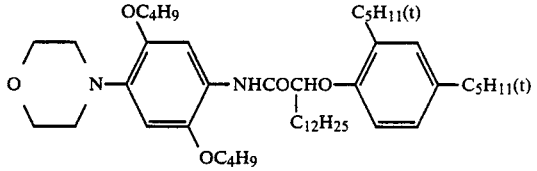
HI-12
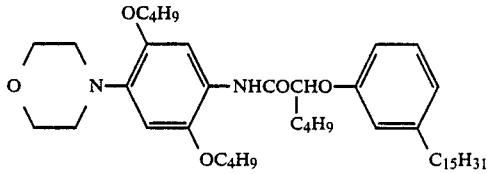
HI-13
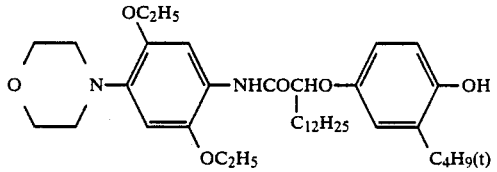
HI-14
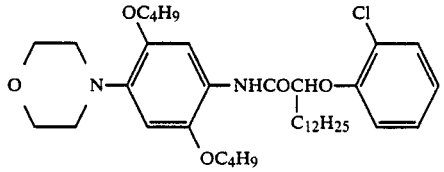
HI-15
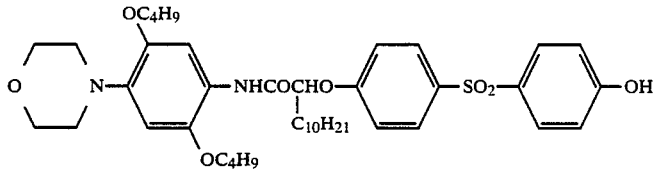
HI-16
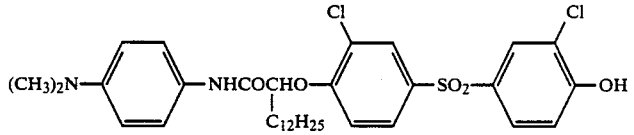

-continued
HI-17
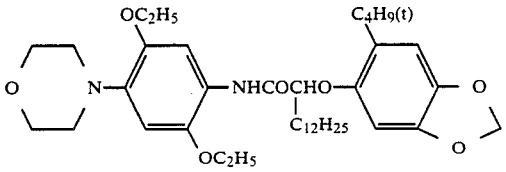
HI-18
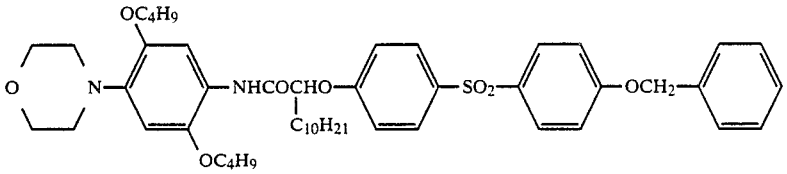
HI-19
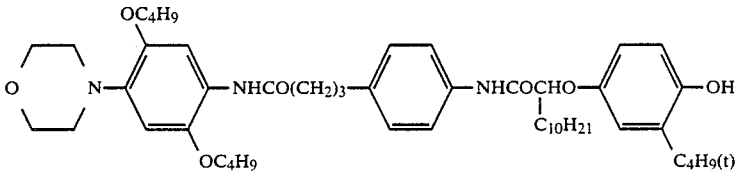
HI-20
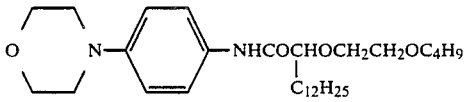
HI-21
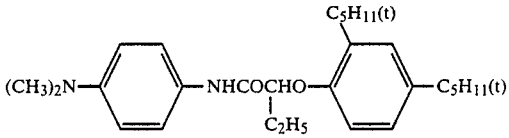
HI-22
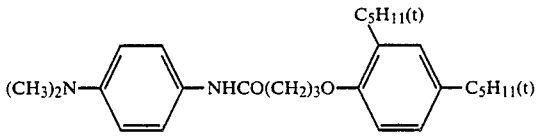
HI-23
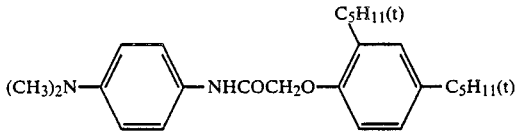
HI-24
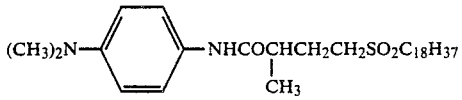
HI-25
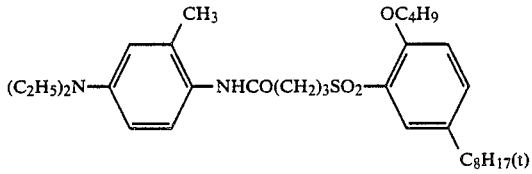
HI-26
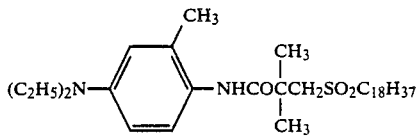

-continued
HI-27
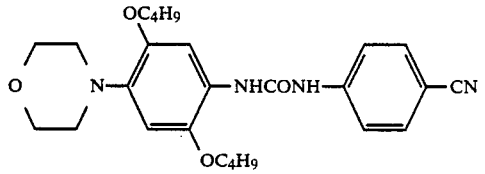
HI-28
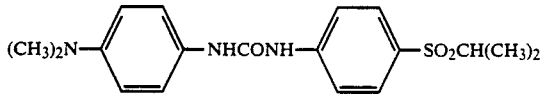
HI-29
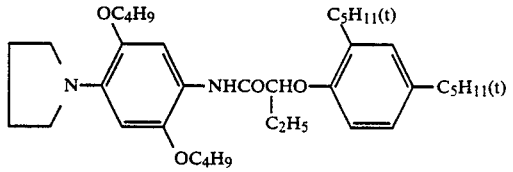
HI-30
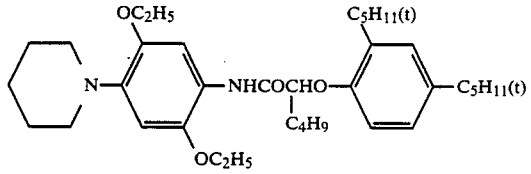
HI-31
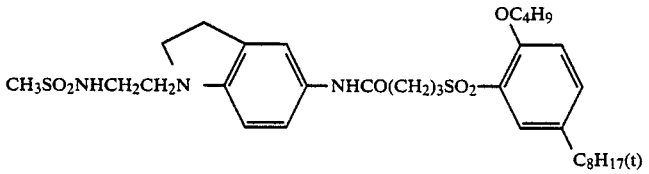
HI-32
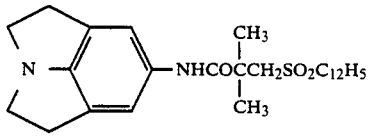
HI-33
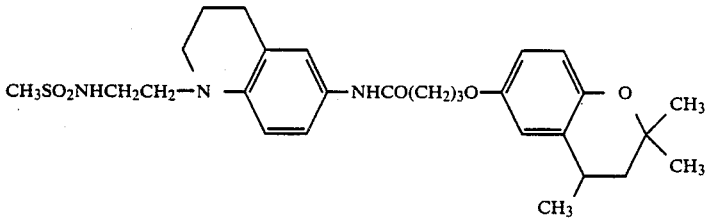
HI-34
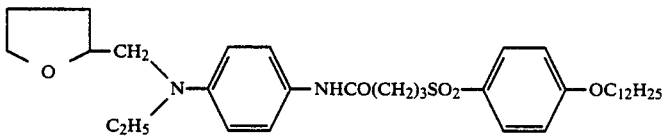
HI-35
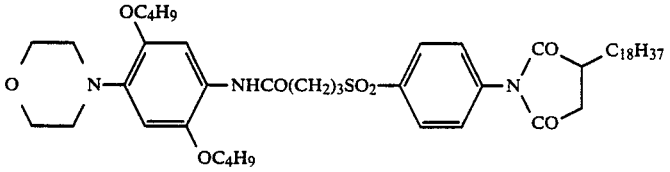

-continued
HI-36
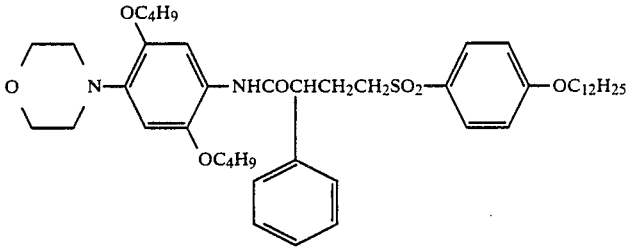
HI-37
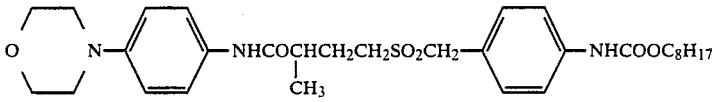
HI-38
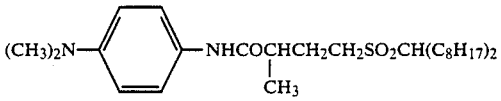
HI-39
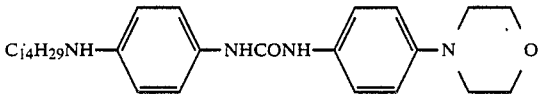
HI-40
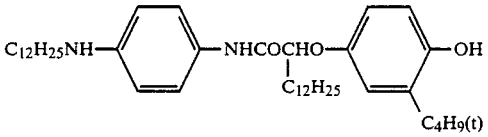
HI-41
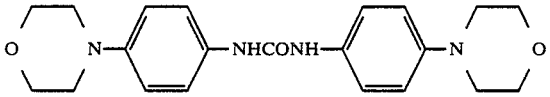
HI-42
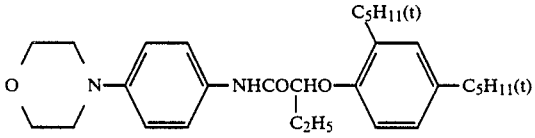
HI-43
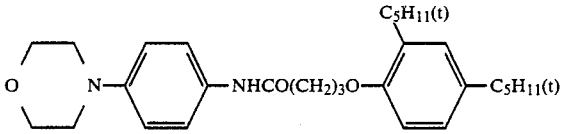
HI-44
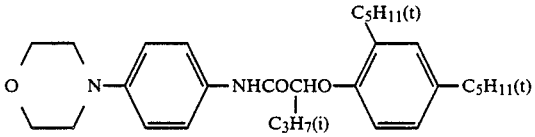
HI-45
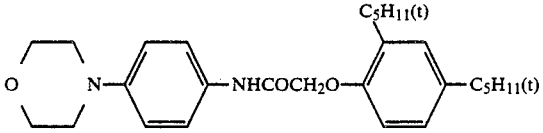
HI-46
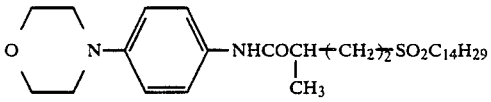

-continued
HI-47
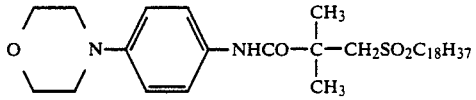
HI-48
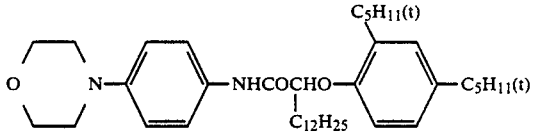
HI-49
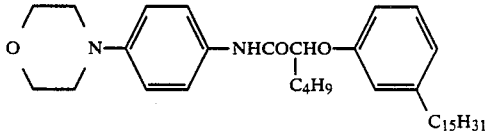
HI-50
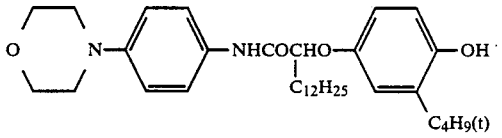
HI-51
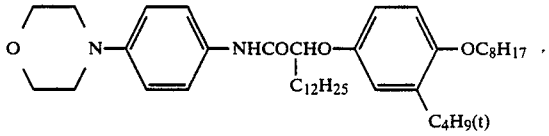
HI-52
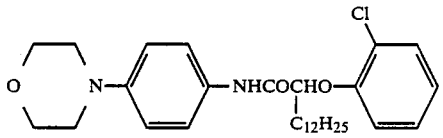
HI-53
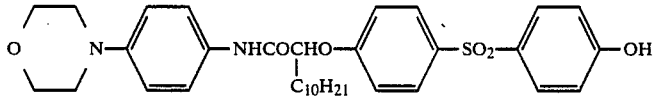
HI-54
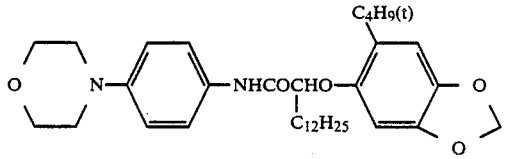
HI-55
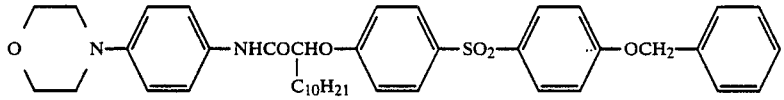
HI-56
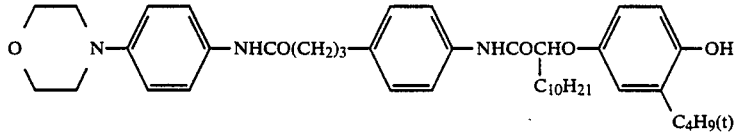
HI-58
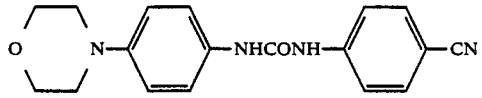

-continued

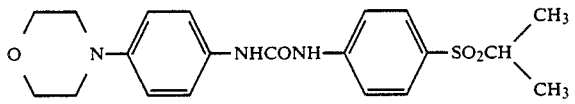

HI-59

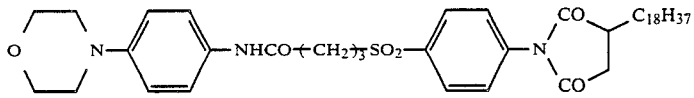

HI-60

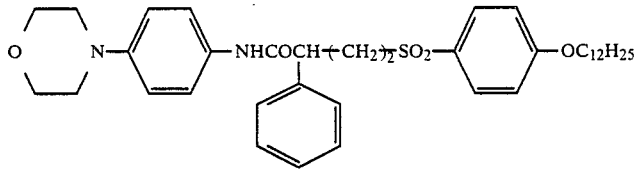

HI-61

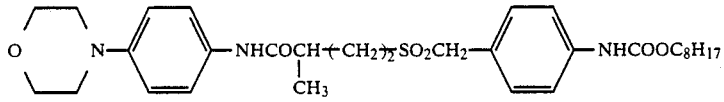

HI-62

Synthesis examples of some of the representative dye image stabilizers of the exemplified compounds are given hereinbelow.

SYNTHESIS EXAMPLE 1

(Synthesis of HI-1)

1 g of N-(4-phenyloxycarbonylamino-2,5-dibutoxyphenyl)morpholine, 0.81 g of N-(4-amino-2,5-dibutoxyphenyl)-morpholine hydrochrolide and 0.17 g of imidazole were mixed with 50 ml of touluene and reacted for 3 hours under heat reflux After reaction resultant was added with 100 ml of water, extracted with ethyl acetate, rinsed twice with water and thereafter dried with magnesium sulfate anhydride. Then under reduced pressure solvent was removed by distillation, to obtain a solid product in pale purple color This solid product was treated by activated carbon and recrystallized from methanol to obtain 0.7 g of white crystals.

Melting point (175°-176° C.), FD Mass spectrum (670) and NMR spectrum supported the structure of N,N'-bis(4-morpholino-2,5-dibutoxyphenyl) urea.

Results of Elementary Analysis

Calculation (%) C: 66.24 H: 8.71 N: 8.35

Experimental (%) C: 66.18 H: 8.73 N: 8.40.

SYNTHESIS EXAMPLE 2

(Synthesis of HI-6)

13 g of N-(4-amino-2,5-dibutoxyphenyl)-morpholine and 9 ml of pyridine were mixed with 150 ml of ethylacetate. Under the room temperature and under agitation 12.2 g of α-2, 4-di-t-amylphenoxybutane acid chloride was added to the mixture and the mixture was subject to further reaction for 1 hour. After reaction the resultant was added with water, extracted with 300 ml of ethyl acetate, rinsed twice with water and thereafter dried with magnesium sulfate anhydride. Then under reduced pressure solvent was removed by distillation, to obtain a residue in dark purple color. This was treated by activated carbon and recrystallized from methanol, to obtain 6 g of white crystals of N-{2,5-dibutoxy-4-(α-2,4-di-t-amylphenoxy)butaneamidephenyl}morpholine.

Melting point (114°-115° C.), FD Mass spectrum (624) and NMR spectrum supported the structure of the above-mentioned product.

Results of Elementary Analysis:

Calculation (%) C: 73.03 H: 9.68 N: 4.48.

Experimental (%) C: 73.00 H: 9.70 N: 4.48

SYNTHESIS EXAMPLE 3

(Synthesis of HI-45)

3.2 g of N-(4-aminophenyl)-morpholine and 5 g of potassium carbonate were added to mixed solvent containing 30 ml of ethyl acetate and 30 ml of water and the mixture was stirred under the room temperature. Under the same condition 5.6 g of 2,4-di-t-amylphenoxyacetyl chloride was added to the mixture and the resultant was subject to further reaction under agitation. After reaction the resultant mixture was subject to extraction with ethyl acetate, rinsing twice with water and thereafter dried with magnesium sulfate anhydride Then under reduced pressure solvent was removed by distillation, to obtain a residue in deep reddish purple color This was then treated by activated carbon and recrystallized from methanol, to obtain 6 g of white crystals.

Melting point (113°-114° C.).

Results of Elementary Analysis $C_{28}H_{40}N_2O_3$

Calculation (%) C: 74.30 H: 8.90 N: 6.19.

Experimental (%) C: 74.28 H: 8.88 N: 6.19.

The amount of the dye image stabilizer of the invention to be employed is not necessarily limited to a specific range, however, generally speaking 5 to 400 mol % with respect to the amount of the coupler of the formula [I] and, more preferably, 10 to 300 mol % is advantageous.

Amine compounds having similar chemical structures are disclosed in Japanese Patent Publication No. 47245/1972, and Japanese Patent O.P.I. Publications No. 105147/1983 and No. 229557/1984. In Japanese Patent Publication No. 47245/1972 it is disclosed that the use of certain class of amine compounds is effective for the prevention of fading of azomethine dyes or indoaniline dyes by light However, this anti-light fading effect of these amine compounds against the azomethine dyes derived from 5-pyrazolone compounds has been found to be inferior to that of other kind of known antifading agents. Japanese Patent O.P.I Publications Nos. 105147/1983 and 229557/1984 disclose the advantageous use of certain class of amine compounds with 2-equivalent pyrazolon magenta couplers for preventing magenta stains likely to generate in the non-image portion.

Although above-mentioned Japanese Patent Publication No. 74245/1972 describes that amine compounds are less likely to cause coloration or discoloration as compared with known UV absorbers, in view of the recent trend in this field of attaching increased importance to the image quality, the coloration caused by the amine compounds cannot be disregarded. Further, since the amine compounds have such a serious disadvantage that they often lower the sensitivity of the photosensitive material when used in combination with a 5-pyrazolone magenta coupler, they have never been employed in the commercial color photographic materials of the printing use On the other hand, compounds represented by the general formula [XII] are known to be used in the light-sensitive photographic material as a precursor of an aromatic primary amine developer as disclosed in West German Patent Applications Nos. 1159758 and 1200679, Research Disclosure No. 12146, U.S. Pat. No. 4060418, Japanese Patent Publications Nos. 14671/1983 and 14672/1983 and Japanese Patent O.P.I. Publications No. 76543/1982, 179842/1982 and 1139/1983. However, when these compounds are used in the photographic material in combination with known 5-pyrazolone magenta couplers, no substantial anti-light fading effect has been obtainable. Therefore, it was unexpected and surprising to realize that the p-phenylene diamine compounds as specified in the present invention could exert anti-fading effect without causing Y-stain or desensitization only when they are used with pyrrazolo triazole dye forming couplers.

It has been generally known in the art that a magenta dye image obtainable from the magenta dye forming coupler as specified in the present invention is not only extremely liable to cause color fading by light but also easily discolored by light and, in addition, hue of the magenta color image often changes to bear yellowish tone.

The compounds as specified by the general formula [XII] have, as a dye image stabilizer, a distinguished advantage over other anti-color fading agents known in the art such as phenol type or phenyl ether type in that the former can effectively prevent color fading and discoloration of dyes obtainable from a specific type of dye forming coupler of the formula, which the latter cannot.

The dye image stabilizer of the present invention may most preferably be incorporated into a same layer which contains the dye forming coupler of the invention, however, the former may also be incorporated into an adjacent layer to the layer containing the latter The silver halide photographic light-sensitive materials, including the color photographic paper, above, can be whichever monochromatic or multi-colored. In principal, a multicolored silver halide photographic light sensitive material has, in order to provide a subtractive color reproduction, a constitution wherein silver halide emulsion layers containing magenta, yellow and cyan couplers serving as photographic couplers as well as non-light sensitive layers are laminated on a support in an adequate number and order, however, the number and order may be arbitrarily modified in compliance with the important performance and utilization purposes.

For the silver halide emulsions employed in the silver photographic light sensitive materials of the invention, any of the silver halides, contained in ordinary silver halide emulsions and containing silver bromide, silver iodo-bromide, silver iodo-chloride, silver chloro-bromide, silver chloride and the like, may be arbitrarily employed.

The silver halide grains employed in the silver halide emulsions may be obtained through whichever an acid process, neutral process or ammonium process. The grains may be allowed to grow at once or may be allowed to develop after forming seed grains. The two methods to form seed grains and to grow grains may be whichever same or different.

In preparing a silver halide emulsion, both halide ions and silver ions may be simultaneously added into an emulsion, or, halide ions may be added into an emulsion containing only silver ions, or, vice versa Additionally, considering the critical growth rate of a silver halide crystal, the halide ions and the silver ions may be added into a mixing kiln whichever consecutively or simultaneously while controlling the pH and pAg values within the kiln, so as to generate the silver halide crystals. After the crystals have grown up, the silver halide constitution within the grains may be transformed by means of a conversion process.

During the course of the production of the silver halide of the invention, the size, configuration, size distribution and growth of silver halide grains may be controlled by, if so required, employing a silver halide solvent.

With the silver halide grains employed in the silver halide emulsion layer of the invention, while the grains are formed and/or developed, the interior and/or surface of the grains are allowed to contain metallic ions, by employing a cadmium salt, zinc slat, lead salt, thallium salt, iridium salt or complex salt, rhodium salt or complex salt, iron salt or complex salt, and, the interior and/or surface of the grains may be endowed with reducing sensitization cores by placing the grains under an adequate reducing atmosphere.

Unnecessary soluble salts may be whichever removed from or remained in the silver halide emulsion of the invention after silver halide grains have satisfactorily grown. If the salts are removed, the removal can be exercised by following the method mentioned in Research Disclosure No 17643.

The interior and the surface of a silver halide grain employed in a silver halide emulsion, according to the invention, may be whichever of the identical layer or different layers.

The silver halide grains employed in the silver halide emulsion of the invention may be the grains wherein a latent image is principally formed whichever on the surface thereof or in the interior thereof.

The silver halide grains employed in the silver halide emulsion of the invention may be the grains having whichever regular crystals or irregular crystals such as circular or sheet-shaped.

Among such grains, the proportion between [100]-faced and [101]-faced crystals may be arbitrarily selected. Additionally such grains may have composites between the crystal configurations, above, or contain grains of various crystal configurations.

More than two of separately prepared silver halide emulsions may be mixed to prepare the silver halide emulsion, according to the invention.

A silver halide emulsion of the invention is chemically sensitized with a conventional method. More specifically, a sulfur sensitization method where a compound or activated gelatin containing sulfur and can react with silver ions, a selenium sensitization method involving a selenium compound, a reducing sensitization method involving a reducing substance, a noble metal sensitization method involving gold and other noble metals and other methods may be independently or combinedly employed.

A silver halide emulsion of the invention can be optically sensitized to the desirable wavelength range by employing a dye known as a sensitizing dye in the photographic art. The sensitizing dyes may be whichever independently or combinedly employed. The emulsion may allowed to contain, in addition to a sensitizing dye, a supersensitizer which is a dye not having a light-sensitization capability or a compound not actually absorbing visible radiation and serving to enhance a sensitization function of the sensitization dye.

Into a silver halide emulsion of the invention may be added a compound, known as an anti-fogging agent or a stabilizer in the photographic art, during and/or at the completion of the chemical ripening of a light sensitive material and/or after the chemical ripening before the coating of a silver halide emulsion, in order to prevent the fogging of the light sensitive material during the preparation, storage and photographic treatment of the similar material.

It is advantageous to use gelatin as a binder (or, a protective colloid) of the silver halide emulsion, according to the invention. Other than this material, above, a gelatin derivative, graft polymer between gelatin and another high polymer, protein, sugar derivative, cellulose derivative, or a hydrophilic colloid derived from synthesized high polymer compound such as a monomer or copolymer may be also employed.

The photographic emulsion layers containing silver halide emulsion of the invention as well as other hydrophilic colloid layers may be hardened by independently or combinedly employing hardeners which bridge binder (or, a protective colloid) molecules so as to enhance the fastness of the layers. The amount of hardners should be so much as to harden the light sensitive material and to the extent that the addition of hardener into processing solutions is not required, however, the addition of the hardener into the processing solutions is also allowable.

In order to improve the plasticity of the silver halide emulsion layers containing light sensitive materials involving silver halide emulsion of the invention and/or other hydrophilic colloid layers, the similar layers may be allowed to have a plasticizer, and, the silver halide emulsion layers containing light sensitive materials involving silver halide emulsion of the invention and other hydrophilic colloid layers are allowed to contain a material (latex) wherein an unsoluble or slightly soluble synthesized polymer is dispersed so as to improve the dimension stability and other properties.

In the emulsion layers of a silver halide color photographic material, a dye forming coupler is employed, and, this dye forming coupler couples, during the color forming development process, with an oxidant derived from an aromatic primary amine developer (for example, a p-phenylenediamine derivative or aminophenol derivative and the like). Normally, the dye forming coupler is selected so that a dye which absorbs a photosensitive spectrum of an emulsion layer can form in every corresponding emulsion layer, and, in a blue-sensitive emulsion layer a yellow dye forming coupler, in a green-sensitive emulsion layer a magenta dye forming coupler, in a red-sensitive emulsion layer a cyan dye forming coupler are respectively employed. However, a combination other than those mentioned above may be employed to prepare a silver halide photographic light sensitive material, in compliance with a specific purpose.

As a cyan dye forming coupler of the invention, a 4-equivalent or 2-equivalent type cyan dye forming couplers derived from phenols or naphthols are typically used, and, the specific examples of which were disclosed as follows: U.S. Pat. No. 2306410, No. 2356475, No. 2362598, No. 2367531, No. 2369929, No. 2423730, No. 2474293, No. 2476008, No. 2498466, No. 2545687, No. 2728660, No. 2772162, No. 2895826, No. 2976146, No. 3002836, No. 3419390, No. 3446622, No. 3476563, No. 3737316, No. 3758308 and No. 3839044; Specifications in U.K. Patents No. 478991, No. 945542, No. 1084480, No. 1377233, No. 1388024 and No. 1543040; Japanese Patent O.P.I. Publications No. 37425/1972, No. 10135/1975, No. 25228/1975, No. 112038/1975, No. 117422/1975, No. 130441/1975, No. 6511/1976, No. 37647/1976, No. 52828/1976, No. 108841/1976, No. 109630/1978, No. 48237/1979, No. 66129/1979, No. 131931/1979 and No. 32071/1980.

Yellow dye-forming couplers to be effectively employed in the present invention include those described, for example, in U.S. Pat. No. 2778658, No. 2875057, No. 2908573, No. 3227155, No. 3227550, No. 3253924, No. 3265506, No. 3277155, No. 3341331, No. 3369895, No. 3384657, No. 3408194, No. 3415652, No. 3447928, No. 3551155, No. 3582322, No. 3725072 and No. 3894875, West German OLS Patents No. 1547868, No. 2057941, No. 2162899, No. 2163812, No. 2213461, No. 2219917, No. 2261361 and No. 2263875, Japanese Patent Examined Publication No. 13576/1974, Japanese Patent O.P.I. Publications No. 29432/1973, No. 66834/1973, No. 10736/1974, No. 122335/ 1974, No. 28834/1975 and No. 132926/1975.

For the silver halide emulsions employed in the silver photographic light sensitive materials of the invention, any of the silver halides, contained in ordinary silver halide emulsions, such as silver bromide, silver iodobromide, silver iodo-chloride, silver chloro-bromide, silver chloride and the like may be arbitrarily employed.

With the silver halide grains employed in the silver halide emulsion layer of the invention, while the grains are formed and/or developed, the interior and/or surface of the grains are allowed to contain metallic ions, by employing a cadmium salt, zinc salt, lead salt, thallium salt, iridium salt or complex salt, rhodium salt or complex salt, iron salt or complex salt, and, the interior and/or surface of the grains may be endowed with reducing sensitization cores by placing the grains under an adequate reducing atmosphere.

Unnecessary soluble salts may be whichever removed from or remained in the silver halide emulsion of the invention after silver halide grains have satisfactorily grown. If the salts are removed, the removal can be exercised by following the method mentioned in Research Disclosure No. 17643.

The silver halide grains employed in the silver halide emulsion of the invention may be the grains having whichever regular crystals or irregular crystals such as circular or sheet-shaped.

A silver halide emulsion of the invention is chemically sensitized with a conventional method.

A silver halide emulsion of the invention can be optically sensitized to the required wavelength range by employing a dye known as a sensitizing dye in the photographic art. The sensitizing dyes may be whichever independently or combinedly employed. The emulsion may allowed to contain, in addition to a sensitizing dye, a supersensitizer which is a dye not having a light-sensitization capability or a compound not actually absorbing visible radiation and serving to enhance a sensitization function of the sensitization dye.

Into a silver halide emulsion of the invention may be added a compound, known as an anti-fogging agent or a stabilizer in the photographic art, during and/or at the completion of the chemical ripening of a light sensitive material and/or after the chemical ripening before the coating of a silver halide emulsion, in order to prevent the fogging of the light sensitive material during the preparation, storage and photographic treatment of the similar material.

In a silver halide photographic light sensitive material may be provided with auxiliary layers such as a filter layer, anti-hallation layer and/or anti-irradiation layer and others. These layers and/or emulsion layers may contain a dye, which flows out of a color sensitive material during a development process, or which is bleached during the similar process.

In order to suppress a gloss of a light sensitive material, to improve retouchability, to prevent mutual adhesion of light sensitive materials, a matting agent may be added into silver halide emulsion layers derived from a silver halide photographic light sensitive material of the invention and/or the other hydrophilic colloid layers.

The photographic emulsion layers derived from the silver halide photographic light sensitive material of the invention as well as other layers may be coated upon a flexible reflex support made of a paper or synthesized paper provided with a lamination of a baryta layer or ?-olefin polymer and the like, or, upon a film comprising a semisynthesized or synthesized high molecule such as a cellulose acetate, cellulose nitrate, polystyrene, polyvinyl chloride, polyethylene terephthalate, polycarbonate, polyamide and others, or, upon a rigid body such as a glass, metal, cetramic and others.

The silver halide photographic light sensitive material may form an image through a color development known in the art.

The aromatic primarine amine color forming developing agent employed in the color developer of the invention contains those known in the art and widely used for various color photographic processes.

According to the invention, after the color development treatment, the material is further treated with a processing solution which has a fixing capability. If the processing solution having a fixing capability is a fixer, the bleaching process is exercised before the treatment with the processing solution.

As can be understood from the discussions, above, the silver halide photographic light sensitive material of the invention features an excellent color reproducibility as well as a decreased Y-stain, in the non-colored area, caused by light, heat or moisture, and, further, with the similar material, a light-resistance of a magenta dye image is remarkably improved and a discoloration due to light is successfully prevented.

EXAMPLE 1

Sample 1 was prepared by coating a photographic emulsion having the following composition on a paper support both surfaces of which are laminated by polyethylene and drying the coating. Coating composition was prepared by the following manner:

Gelatin (15.0 mg/100cm$^2$) and a Comparative magenta coupler (1) (6.0 mg/100 cm$^2$) were dissolved together with 2,5-t-octylhydroquinone (0.8 mg/100 cm$^2$) into dibutylphthalate (5.0 mg/100 cm$^2$) and dispersed therein. Thus prepared dispersion was mixed with silver chlorobromide emulsion containing 80 mol % silver bromide (3.8 mg/100 cm$^2$) to prepare the coating composition. Note that the figure in the parentheses represents dry coating amount.

Samples 4, 7, 10, 13, 16 and 19 were prepared in the same manner as Sample 1 except that in these samples Comparative magenta couplers (2), (3) and (4) and Exemplified magenta couplers M-2, M-3 and M-10 were used respectively instead of Comparative magenta coupler (1).

Samples 2, 5, 8, 11, 14, 17 and 20 were prepared respectively in the same manner as Samples 1, 4, 7, 10, 13, 16 and 19 provided that in these samples HI-1 as the dye image stabilizer was added to the composition in the same amount in terms of mol number as the magenta coupler.

Further Samples 3, 6, 9, 12, 15, 18 and 21 were prepared respectively in the same manner as Samples 2, 5, 8, 11, 14, 17 and 20 provided that in these samples Comparative dye image stabilizers PH-1, PH-2, PH-3, PH-4, PH-5, PH-6 and PH-7 were added respectively to the composition in the same amount in terms of mol number as the magenta coupler instead of HI-1.

The chemical structures of the comparative couplers and comparative dye image stabilizers are given below:

Comparative Coupler (1)

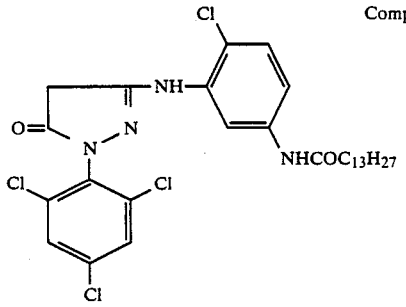

Comparative Coupler (2)

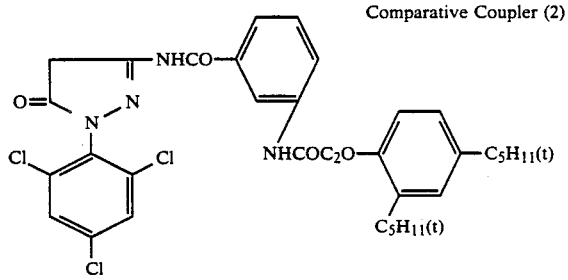

-continued

Comparative Coupler (3)

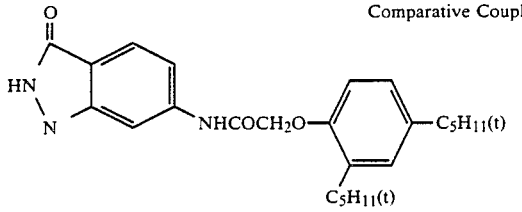

Comparative Coupler (4)

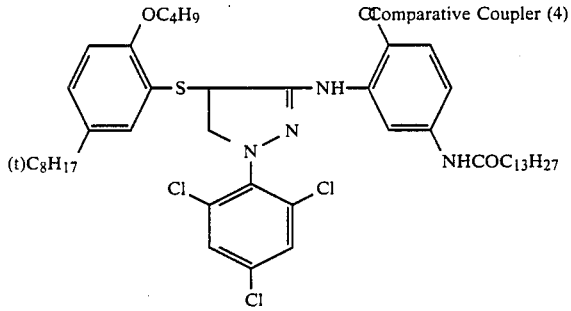

PH-1

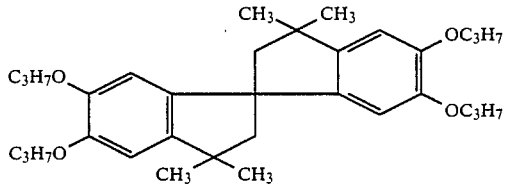

PH-2

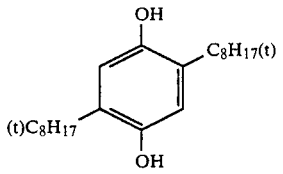

PH-3

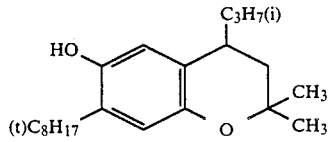

PH-4

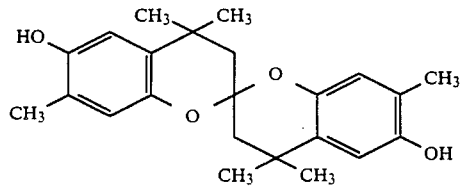

PH-5

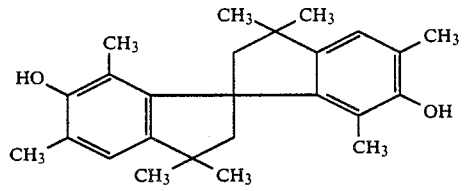

PH-6

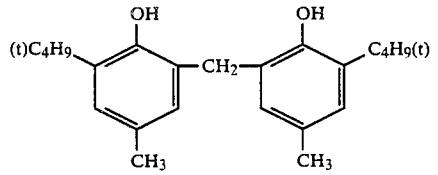

-continued

PH-7

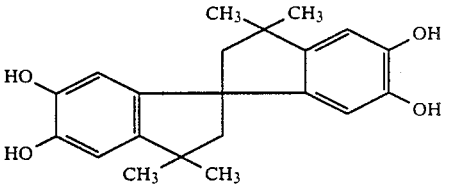

After exposing every sample, prepared above, to a light through an optical wedge, according to a conventional method, each sample was treated with the following processes.

| [Treatment] | Processing temperature | Processing time |
|---|---|---|
| Color development | 33° C. | 3 min 30 sec |
| Bleach-fixing | 33° C. | 1 min 30 sec |
| Rinsing | 33° C. | 3 min |
| Drying | 50~80° C. | 2 min |

The components of respective processing solutions are as follows.

| [Color developer solution] | |
|---|---|
| Benzyl alcohol | 12 ml |
| Diethylene glycol | 10 ml |
| Potassium carbonate | 25 g |
| Sodium bromide | 0.6 g |
| Sodium sulfite anhidride | 2.0 g |
| Hydroxylamine sulfate | 2.5 g |
| N-ethyl-N-β-methanesulfonamidethyl-3-methyl-4-aminaniline sulfate | 4.5 g |

Water was added to the components to make a 1 l solution, wherein NaOH was added to adjust the pH value at 10.2.

| [Bleach-fixing solution] | |
|---|---|
| Ammonium thiosulfate | 120 g |
| Sodium metabisulfite | 15 g |
| Sodium sulfite anhidride | 3 g |
| EDTA ferric ammoniate | 65 g |

Water was added to the components to make a 1 l solution, wherein the pH value was adjusted to 6.7 ~6.8.

The densities of the samples 1~21, treated as above, were measured with a densitometer (model, KD - 7R; manufactured by Konishiroku Photo Industry Co., Ltd.) under the following conditions.

The treated samples were exposed to a xenon fadeometer for 10 days, in order to examine the light-resistance of the dye images and generation of Y-stain (hereinafter referred to as YS) in the non-image portion. Criteria of measurements of the light-resistance of the dye images and YS are as follows.

Survival ratio

This is the residue percent of dye after the light-resistance test as compared with the initial density of the sample before the test which is normalized as I.O.

YS

This was measured by the difference in the Y-stain densities of the sample between before and after the light resistance test. Thus the smaller the figure is the more the generation of Y-stain is restricted.

Discoloration degree

This value is determined by subtracting (yellow density)/ (magenta density) before the light-resistance test at a dye image portion from (yellow density)/(magenta density) after the light-resistance test. It means that the greater the value is, the more the magenta color is prone to turn to yellow tone.

Results are given in Table 1.

TABLE 1

| Sample No. | Magenta coupler | Dye-image stabilizer | Light resistance Survival ratio | YS | Discoloration | *Sensitivity |
|---|---|---|---|---|---|---|
| 1 (Com.) | Com-(1) | — | 50% | 0.54 | 0.34 | 100 |
| 2 (Com.) | Com-(1) | HI-1 | 58 | 0.70 | 0.77 | 80 |
| 3 (Com.) | Com-(1) | PH-1 | 80 | 0.53 | 0.30 | 97 |
| 4 (Com.) | Com-(2) | — | 42 | 0.51 | 0.38 | 94 |
| 5 (Com.) | Com-(2) | HI-1 | 52 | 0.63 | 0.60 | 77 |
| 6 (Com.) | Com-(2) | PH-2 | 60 | 0.50 | 0.36 | 94 |
| 7 (Com.) | Com-(3) | — | 35 | 0.43 | 0.44 | 85 |
| 8 (Com.) | Com-(3) | HI-1 | 42 | 0.74 | 0.60 | 70 |
| 9 (Com.) | Com-(3) | PH-3 | 60 | 0.40 | 0.44 | 83 |
| 10 (Com.) | Com-(4) | — | 55 | 0.17 | 0.36 | 103 |
| 11 (Com.) | Com-(4) | HI-1 | 60 | 0.36 | 0.60 | 80 |
| 12 (Com.) | Com-(4) | PH-4 | 80 | 0.15 | 0.34 | 100 |
| 13 (Com.) | M-2 | — | 22 | 0.06 | 0.78 | 105 |
| 14 (Inv.) | M-2 | HI-1 | 80 | 0.04 | 0.18 | 100 |
| 15 (Com.) | M-2 | PH-5 | 70 | 0.11 | 0.70 | 100 |
| 16 (Com.) | M-3 | — | 23 | 0.06 | 0.74 | 110 |
| 17 (Inv.) | M-3 | HI-1 | 76 | 0.04 | 0.18 | 107 |
| 18 (Com.) | M-3 | PH-6 | 73 | 0.09 | 0.72 | 105 |
| 19 (Com.) | M-4 | — | 35 | 0.06 | 0.77 | 98 |
| 20 (Inv.) | M-4 | HI-1 | 82 | 0.02 | 0.14 | 97 |
| 21 (Com.) | M-4 | PH-7 | 75 | 0.11 | 0.68 | 96 |

*Relative sensitivity compared with Sample 1 of which sensitivity is normalized as 100.

The results in Table 1 illustrate that the significantly improved dye image survival ratio in the light-resistance test, though accompanying a slightly greater discoloration, when compared with samples 2~9.

It is understood from Table 1 that Samples 13, 16 and 19, in which couplers having small secondary absorption to be employed in the present invention were used without the use of the dye-image stabilizer, have shown improved resistance in comparison with Samples 1 and 4, in which conventional 3-anilino-5-pyrazolone couplers were employed, and with Sample 7, in which an indazolone coupler was employed. However it is also understood these samples have shown, from the light resistance test, poor dye-image survival ratio and discoloration and thus they are liable to color fading and discoloration.

Samples 15, 18 and 21, in which couplers to be used in the present invention and known dye-image stabilizers PH-5, PH-6 and PH-7 which are outside the scope of the invention were employed, have shown to improve survival ratio of the dye-image, however, without no substantial improvement in the resistance against discoloration.

On the other hand, in Samples 2, 5, 8 and 11, in which conventional 5-pyrazolone couplers and indazolone coupler in combination with a known dye-image stabilizer were employed, no substantial improvements in dye-image survival and in resistance against YS have been observed and, in addition, some desensitization has been observed.

Samples 14, 17 and 20, in which couplers and dye-image stabilizer both within the scope of the present invention were employed and which are, therefore, in accordance with the present invention, have shown unexpectedly remarkable improvements in the light resistance test without causing any substantial fading and discoloration in the dye image portion, generation of Y-stains in the non-dye image portion and without causing desensitization.

EXAMPLE 2

Samples 22 to 30 were prepared and the light resistance tests were carried out in the same manner as in EXAMPLE 1 except that in this example couplers and dye-image stabilizers used were those listed in Table 2. The results thus obtained are shown in Table 2.

TABLE 2

| Sample No. | Magenta coupler | Dye-image stabilizer | Light resistance Survival ratio | YS | Discoloration | *Sensitivity |
|---|---|---|---|---|---|---|
| 22 (Com.) | M-61 | — | 32% | 0.06 | 0.70 | 100 |
| 23 (Com.) | M-61 | PH-3 | 60 | 0.07 | 0.66 | 97 |
| 24 (Inv.) | M-61 | HI-6 | 88 | 0.06 | 0.11 | 99 |
| 25 (Inv.) | M-61 | HI-6 | 85 | 0.06 | 0.10 | 97 |
| 26 (Inv.) | M-61 | HI-13 | 83 | 0.06 | 0.12 | 98 |
| 27 (Inv.) | M-61 | HI-30 | 65 | 0.07 | 0.15 | 80 |
| 28 (Inv.) | M-61 | HI-31 | 60 | 0.07 | 0.16 | 80 |
| 29 (Inv.) | M-61 | HI-40 | 91 | 0.06 | 0.10 | 101 |
| 30 (Inv.) | M-61 | HI-43 | 93 | 0.06 | 0.10 | 99 |

*Relative sensitivity as compared with Sample 22 when the sensitivity thereof is normalized as 100.

It is apparent from Table 2 that Samples 24 to 30, in which coupler and dye-image stabilizer within the scope of the invention were employed in combination, have shown improved light resistive characteristics especially against color fading and discoloration in the image portion and occurrence of Y-stain in the non-image portion.

EXAMPLE 3

The following layers were sequentially provided upon a paper support which has been laminated with polyethylene on both sides, in order to prepare a multicolor silver halide photographic light sensitive material, thus obtaining sample 31.

First layer: Blue-sensitive silver halide emulsion layer

Those coated were α-pivaloyl-α-(2,4-dioxo-1-benzylimidazolidine-3-yl)-2-chloro-5-[α-(2,4-di-t-amylphenoxy)butylamide] acetanilide as a yellow coupler at the rate of 6.8 mg/100 $cm^2$, a blue-sensitive silver chloro-bromide emulsion (containing 85 mol % silver bromide) at the rate equal to 3.2 mg silver per 100 $cm^2$, dibutylphthalate at the rate of 3.5 mg/100 $cm^2$ and gelatin at the rate of 13.5 mg/100 $cm^2$.

Second layer: Intermediate layer

Those coated were 2,5-di-t-oxtylhydroquinone at the rate of 0.5 mg/100 $cm^2$, dibutylphthalate at the rate of 0.5 mg/ 100 $cm^2$ and gelatin at the rate of 9.0 mg/100 $cm^2$.

Third layer: Green-sensitive silver halide emulsion layer

Those coated were the magenta coupler M-62 of the present invention at the rate of 3.5 mg/100 $cm^2$, a green-sensitive silver chloro-bromide emulsion (containing 80 mol % silver bromide) at the rate equal to 2.5 mg silver per 100 $cm^2$, dibutylphthalate at the rate of 3.0 mg/100 $cm^2$ and gelatin at the ratio of 12.0 mg $cm^2$.

Fourth layer: Intermediate layer

Those coated were 2-(2-hydroxy-3-sec-butyl-5-t-butylphenyl) benzotriazole at the rate of 7.0 mg/100 $cm^2$, dibutylphthalate at the rate of 6.0 mg/$cm^2$, 2,5-di-t-octylhydroquinone at the rate of 0.5 mg/$cm^2$ and gelatin at the rate of 12.0 mg/100 $cm^2$.

Fifth layer: Red-sensitive silver halide emulsion layer

Those coated were 2-[α-(2,4-di-t-pentylphenoxy)-butanamide]-4,6-dichloro-5-ethylphenol working as a cyan coupler at the rate of 4.2 mg/100 $cm^2$, a red-sensitive silver chlorobromide emulsion (containing 80 mol % silver bromide) at the rate equal to 3.0 mg silver per 100 $cm^2$, tricresylphosphate at the rate of 3.5 mg/$cm^2$ and gelatin at the rate of 11.5 mg/ 100 $cm^2$.

Sixth layer: Protective layer

Gelatin was coated at the rate of 8.0 mg/100 $cm^2$.

The multi-layered Samples 32~43 were prepared in the same manner as Sample 31 except that dye image stabilizers as listed in Table 3 were respectively added to these samples of the invention at the proportions shown in Table 3. After the samples were exposed to light and were processed in the same manner as in Example 1, they were subjected to the light-resistance test where every sample was exposed to a xenon fade-ometer for 15 days, to obtain the results as shown in Table 3.

TABLE 3

| Sample No. | Dye-image stabilizer | Amount of addition (mol %/compler) | Survival ratio of magenta dye (%) |
|---|---|---|---|
| 31 (Com.) | — | — | 21 |
| 32 (Inv.) | HI-6 | 50 | 56 |
| 33 (Inv.) | HI-6 | 100 | 68 |
| 34 (Inv.) | HI-6 | 150 | 85 |
| 35 (Inv.) | HI-10 | 50 | 55 |
| 36 (Inv.) | HI-10 | 100 | 66 |
| 37 (Inv.) | HI-10 | 150 | 80 |
| 38 (Inv.) | HI-28 | 50 | 44 |
| 39 (Inv.) | HI-28 | 100 | 60 |
| 40 (Inv.) | HI-28 | 150 | 78 |
| 41 (Inv.) | HI-43 | 50 | 61 |
| 42 (Inv.) | HI-43 | 100 | 76 |
| 43 (Inv.) | HI-43 | 150 | 92 |

The results show that the dye-image stabilizer as specified in the present invention is effective for the stabilization of the magenta coupler as specified in the present invention and the effect of the invention is enhanced by adequately increasing the amount of addition.

The results also show that Samples 32 to 43 have improved resistance against color fading.

Further, it has been found that with the samples according to the present invention the total color balance as color photographic materials remained excellent even after the light resistance test due to the improved properties against color fading and discoloration of the samples, which shows the improved color reproduction property of the photographic materials using the present invention after extended storage.

What is claimed is:

1. A silver halide photographic light-sensitive material comprising a pyrrazolotriazole coupler represented by Formula [I]:

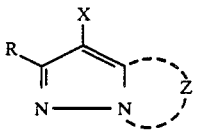

Formula [I]

wherein Z represents a group of non-metallic atoms necessary to form a nitrogen-containing heterocyclic ring; X represents a hydrogen atom or a substituent capable of splitting off upon reaction with an oxidation product of a color developing agent; R represents a hydrogen atom or a substituent;

and a stabilizer represented by Formula [XIII]:

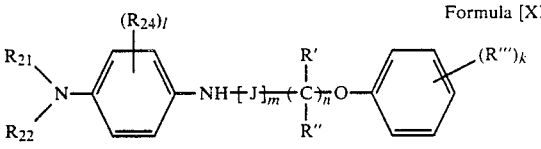

Formula [XIII]

wherein R' and R'' independently represent a hydrogen atom and an alkyl group, $R_{21}$, and $R_{22}$ and R''' independently represent a hydrogen atom, an alkyl group, a cycloalkyl group, an alkenyl group, an aryl group, and a heterocyclic group, provided that $R_{21}$ and $R_{22}$ may be combined with each other to form a 5- or 6-membered ring; $R_{24}$ represents a substituent, provided that $R_{24}$ may be combined with $R_{21}$, $R_{22}$ and a nitrogen atom adjacent to $R_{21}$ and $R_{22}$ to form a 5- or 6-membered ring; J represents one selected from the group consisting of:

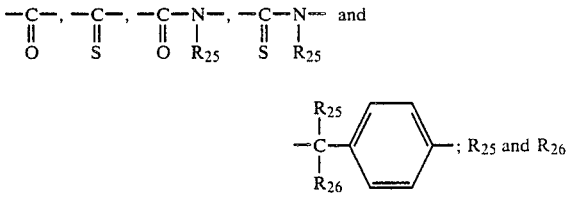

represent independently a hydrogen atom and an alkyl group; l represents an integer of 0 to 4, provided that the $R_{24}$'s may be the same or different when l is two or more; m is 0 or 1; n represents an integer of 1 to 3; and k represents an integer of 0 to 5.

2. The silver halide photographic light-sensitive material of claim 1, wherein said substituent for R is selected from the group consisting of a halogen atom, an alkyl group, a cycloalkyl group, an alkenyl group, an cycloalkenyl group, an alkinyl group, an aryl group, a heterocyclic group, an acyl group, a sulfonyl group, a sulfinyl group, a phosphonyl group, a carbamoy group, a sufamoyl group, a cyano group, a spiro compound residue, a bridged hydroatrbon compound, an alkoxy group, an aryloxy group, a heterocyclic oxy group, a siloxy group, an acyloxy group, a carbamoyloxy group, an amino group, an acylamino group, a sulfonamide group, an imide group, a ureide group, a sufamoylamino group, an alkoxycarbonyl group, an aryloxycarbonyl group, an alkythio group, an arylthio group and a heterocycicthio group.

3. The silver halide photographic light-sensitive material of claim 1, wherein X in formula [I] is selected from the group consisting of a halogen atom and an organic group having a carbon atom, an oxygen atom, a sulfur atom or a nitrogen atom through which said organic group is connected with the remainder of the formula.

4. The silver halide photographic light-sensitive material of claim 1, wherein X in formula [I] is selected from the group consisting of a halogen atom, an alkoxy group, an aryloxy group, a heterocyclicoxy group, an acyloxy group, a sulfonyloxy group, an alkoxycabonyloxy group, an aryloxycarbonyloxy group, an alkyloxalyloxy group, an akylthio group, an arylthio group, a heterocyclicthio group, an alkyloxythiocarbonylthio group, a group represented by the formula

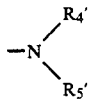

wherein $R_4'$ and $R_5'$ independently represent a hydrogen atom, an aikyl group, an aryl group, a heterocyclic group, a sulfamoyl group, a carbamoyl group, an acyl group, a sulfonyl group, an aryloxycarbonyl and an alkoxycarbonyl group provided that $R_4'$ and $R_5'$ are not simultaneously hydrogen atoms and $R_4'$ and $R_5'$ may combine with each other to form a nitrogen-containing heterocyclic group, a hydroxymethy group, a triphenylmethyl group and a group represented by the following formula:

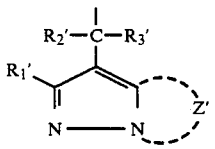

wherein $R_1$ is defined to be the same as R, Z' is defined to be the same as Z, and $R_2'$ and $R_3'$ are independently selected from the group consisting of a hydrogen atom, an aryl group, an akyl group and a heterocyclic group.

5. The silver halide photographic light-sensitive material of claim 1, wherein $R_{21}$ and $R_{22}$ of formula [XIII] represent a group of atoms necessary to complete a 5- or 6-membered ring together with the nitrogen atom present adjacent thereto.

6. The silver halide photographic light-sensitive material of claim 1, wherein m is 1 and J is

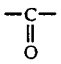

group.

7. The silver halide photographic light-sensitive material of claim 1, wherein l is 0.

8. The silver halide photographic light-sensitive material of claim 1, wherein said compound [XII] is in accordance with formula [XIV]:

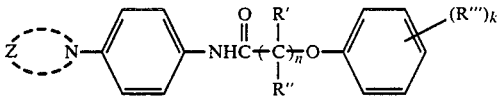

[XIV]

wherein Z represents a group of atoms necessary to complete a 5- or 6-membered ring, R' and R'' independently represent a hydrogen atom or an alkyl group, R''' is the same as $R_{24}$, n is an integer of 1 to 3, and k is an integer of 0 to 5.

* * * * *